US011739493B2

(12) United States Patent
Nicol et al.

(10) Patent No.: US 11,739,493 B2
(45) Date of Patent: Aug. 29, 2023

(54) SEGMENTAL RETAINING WALL BLOCK WITH INTEGRAL VERTICAL INTERLOCK SYSTEM

(71) Applicant: Risi Stone Inc., Newmarket (CA)

(72) Inventors: Brock Nicol, Newmarket (CA); Tyler Matys, Newmarket (CA)

(73) Assignee: Risi Stone Inc., Newmarket (CA)

( * ) Notice: Subject to any disclaimer, the term of this patent is extended or adjusted under 35 U.S.C. 154(b) by 0 days.

(21) Appl. No.: 17/533,802

(22) Filed: Nov. 23, 2021

(65) Prior Publication Data

US 2022/0162826 A1 May 26, 2022

(30) Foreign Application Priority Data

Nov. 24, 2020 (CA) ..... 3100488

(51) Int. Cl.
*E02D 29/02* (2006.01)
*E04C 1/39* (2006.01)

(52) U.S. Cl.
CPC ..... *E02D 29/025* (2013.01); *E02D 29/0266* (2013.01); *E04C 1/395* (2013.01)

(58) Field of Classification Search
CPC ... E02D 29/025; E02D 29/0266; E04C 1/395; B28B 7/0079; E04B 2002/0204; E04B 2002/0208
See application file for complete search history.

(56) References Cited

U.S. PATENT DOCUMENTS 250,635 A * 12/1881 McLean ..... E04C 1/42 405/114
5,353,569 A * 10/1994 Rodrigue ..... E04C 1/395 52/612
5,622,456 A * 4/1997 Risi ..... E02D 29/025 405/262
6,019,550 A * 2/2000 Wrigley ..... E02D 29/0241 405/262
6,152,655 A * 11/2000 Hull ..... E04C 1/395 52/592.6

(Continued)

FOREIGN PATENT DOCUMENTS

WO WO-9716610 A1 * 5/1997 ..... E04B 2/52

*Primary Examiner* — Carib A Oquendo
(74) *Attorney, Agent, or Firm* — Dickinson Wright LLP; Matthew D. Powell

(57) ABSTRACT

A retaining wall block includes a block body having a top side and a bottom side parallel to the top side, each of the top side and the bottom side being trapezoidal in shape and symmetrical with respect to a central vertical plane; a front side and a rear side parallel to the front side; and a right side and a left side opposite the right side. The retaining wall block includes a vertical interlock system having a groove having a groove depth and a groove width and extending transverse to the central vertical plane along the bottom side from the left side to the right side; and a key extending transverse to the central vertical plane along the top side and having a maximum key width that is smaller than or equal to the groove width, the key having a maximum key height that is smaller than or equal to the groove height, wherein the key has a left side portion and a right side portion, and each of the left side portion and the right side portion is shaped to reduce in width toward both the left and right sides of the block.

19 Claims, 18 Drawing Sheets

(56) References Cited

U.S. PATENT DOCUMENTS

| | | | | |
|---|---|---|---|---|
| 2002/0152709 | A1* | 10/2002 | Gresser | E04C 1/395 52/561 |
| 2008/0085162 | A1* | 4/2008 | Blundell | E02D 29/0266 405/284 |
| 2021/0108390 | A1* | 4/2021 | Matys | E02D 29/0266 |

* cited by examiner

SEGMENTAL RETAINING WALL BLOCK WITH INTEGRAL VERTICAL INTERLOCK SYSTEM

CROSS-REFERENCE TO RELATED APPLICATION

This application claims priority under 35 U.S.C. 119 to Canadian Patent Application No. 3,100,488 filed on Nov. 24, 2020 and titled "SEGMENTAL RETAINING WALL BLOCK WITH INTEGRAL VERTICAL INTERLOCK SYSTEM", the contents of which are incorporated herein by reference.

FIELD OF THE INVENTION

The present disclosure relates generally to prefabricated interlocking concrete blocks, and more particularly to segmental retaining wall blocks with integral vertical interlock systems useful for forming curved and straight segmental retaining walls.

BACKGROUND OF THE INVENTION

Interlocking concrete blocks are used for many outdoor construction applications, one of the most common being the construction of retaining walls. Interlocking concrete blocks are thus designed for durability, stability, and aesthetic appeal.

One of the main benefits of segmental retaining walls (SRWs), as compared to more rigid reinforced concrete walls, is the ability to be constructed in complex geometries, such as curves, inside and outside corners, and freestanding two-sided walls such as seat walls.

U.S. Pat. No. 5,622,456 to Risi et al. issued on Apr. 22, 1997, the contents of which are incorporated herein by reference, disclosed trapezoidal retaining wall blocks having a positive interlock. The retaining wall blocks of the '456 patent included an integral tongue (or "key") with a width at middle distance that corresponded to the width of the groove of another like block into which it would be fitted, but that became smaller in width from this middle distance toward each of the left-hand and right-hand sides of the block. Such blocks were made available to construct strong segmental walls in either straight or curved/serpentine fashion, with concave or convex surfaces, while providing an interlocking system that would provide vertical interlocking between courses of blocks in either configuration. The blocks could be stacked with blocks of the same type or with other types, such as coping and corner blocks.

In curved wall configurations, the retaining wall blocks of the '456 patent have front and rear planar faces that, from course to course, are offset in angle with respect to each other. Because the front and rear faces are planar, where a block in an upper course spans two blocks in a lower course, the two lower course blocks form somewhat of a shelf under the front face of the upper course block, and the upper course block forms overhangs over the rear face of the lower course blocks. The extent to which the shelf protrudes is at its maximum at the midpoint of the upper course block—where the two lower course blocks abut each other. While some relative protrusion is a byproduct of forming curves using planar-faced retaining wall blocks, the protrusions become more noticeable as the faces of the blocks become wider with respect to the curve radius. Certain designs that call for smooth, wide block faces in order to achieve clean, linear lines for a wall are more difficult to achieve when such wider blocks are used in the curves.

SUMMARY OF THE INVENTION

In accordance with an aspect, there is provided a retaining wall block comprising a block body comprising: a top side and a bottom side parallel to the top side, each of the top side and the bottom side being trapezoidal in shape and symmetrical with respect to a central vertical plane; a front side and a rear side parallel to the front side; and a right side and a left side opposite the right side; and a vertical interlock system comprising: a groove having a groove depth and a groove width and extending transverse to the central vertical plane along the bottom side from the left side to the right side; and a key extending transverse to the central vertical plane along the top side and having a maximum key width that is smaller than or equal to the groove width, the key having a maximum key height that is smaller than or equal to the groove height, wherein the key has a left side portion and a right side portion, and each of the left side portion and the right side portion is shaped to reduce in width toward both the left and right sides of the block.

In an embodiment, at least one of the left side portion and the right side portion is shaped to reduce in width from the maximum key width toward both the left and right sides of the block.

In an embodiment, the left side portion of the key has a first segment and a second segment between the first segment and the central vertical plane, the first segment having a rear-facing wall that is normal to the central vertical plane and a front-facing wall that is normal to the left side, the second segment having a rear-facing wall that is normal to the left side and a front-facing wall that is normal to the central vertical plane; and the right side portion of the key has a third segment between a fourth segment and the central vertical plane, the third segment having a rear-facing wall that is normal to the right side and a front-facing wall that is normal to the central vertical plane, the fourth segment having a rear-facing wall that is normal to the central vertical plane and a front-facing wall that is normal to the right side.

In an embodiment, at least the first segment and the second segment are contiguous.

In an embodiment, the rear-facing wall of the first segment and the rear-facing wall of the second segment meet at about halfway between the central vertical plane and the left side of the retaining wall block; and the front-facing wall of the first segment and the front-facing wall of the second segment meet at about halfway between the central vertical plane and the left side of the retaining wall block.

In an embodiment, at least the third segment and the fourth segment are contiguous.

In an embodiment, the rear-facing wall of the third segment and the rear-facing wall of the fourth segment meet at about halfway between the central vertical plane and the right side of the retaining wall block; and the front-facing wall of the third segment and the front-facing wall of the fourth segment meet at about halfway between the central vertical plane and the right side of the retaining wall block.

In an embodiment, the first, second, third and fourth segments are contiguous.

In an embodiment, the left portion and the right portion are mirrored in shape and position about the vertical plane.

In an embodiment, the key is farther from the front side of the retaining wall block than is the groove.

In an embodiment, each of the groove and the key is bevelled.

According to another aspect, there is provided a retaining wall block comprising a block body comprising: a top side and a bottom side parallel to the top side, each of the top side and the bottom side being trapezoidal in shape and symmetrical with respect to a central vertical plane; a front side and a rear side parallel to the front side; and a right side and a left side opposite the right side; and a vertical interlock system comprising: a groove having a groove depth and a groove width and extending transverse to the central vertical plane along the bottom side from the left side to the right side; and a key extending transverse to the central vertical plane along the top side and having a maximum key width that is smaller than or equal to the groove width, the key having a maximum key height that is smaller than or equal to the groove height, wherein the key includes a first rear-facing wall segment and a fourth rear-facing wall segment that are both normal to the central vertical plane and that together flank a second rear-facing wall segment and a third rear-facing wall segment, wherein the second rear-facing wall segment and the third rear-facing wall segment are normal to the left side and to the right side respectively, the key also including first and fourth front-facing wall segments that are normal to the left side and the right side respectively and that together flank a second front-facing wall segment and a third front-facing wall segment that are both normal to the central vertical plane.

In an embodiment, the first, second, third and fourth rear-facing wall segments are contiguous, and the first, second, third and fourth front-facing wall segments are contiguous.

In an embodiment, the key is mirrored in shape and position about the central vertical plane.

In an embodiment, the first rear-facing wall segment and the second rear-facing wall segment meet at about halfway between the central vertical plane and the left side of the retaining wall block; and the first front-facing wall segment and the second front-facing wall segment meet at about halfway between the central vertical plane and the left side of the retaining wall block.

In an embodiment, the third rear-facing wall segment and the fourth rear-facing wall segment meet at about halfway between the central vertical plane and the right side of the retaining wall block; and the third front-facing wall segment and the fourth front-facing wall segment meet at about halfway between the central vertical plane and the right side of the retaining wall block.

In an embodiment, the key is farther from the front side of the retaining wall block than is the groove.

In an embodiment, a first rear vertical plane along which the first and fourth rear-facing wall segments extend intersects a second rear vertical plane along which the second rear-facing wall extends at about halfway between the central vertical plane and the left side of the retaining wall block; and the first rear vertical plane intersects a third rear vertical plane along which the third rear-facing wall extends at about halfway between the central vertical plane and the right side of the retaining wall block.

In an embodiment, a first front vertical plane along which the second and third front-facing wall segments extend intersects a second rear vertical plane along which the first front-facing wall extends at about halfway between the central vertical plane and the left side of the retaining wall block; and the first front vertical plane intersects a third front vertical plane along which the fourth front-facing wall extends at about halfway between the central vertical plane and the right side of the retaining wall block.

In an embodiment, each of the groove and the key is bevelled.

BRIEF DESCRIPTION OF THE FIGURES

Embodiments will now be described more fully with reference to the accompany drawings, in which.

DETAILED DESCRIPTION OF THE EMBODIMENTS

The present description is directed to a trapezoidal retaining wall block having a key configuration that, as compared with the prior art, causes a retaining wall block in a curve of a wall to sit further forward with respect to retaining wall blocks in lower-courses with which it is interlocked. Because the retaining wall block is sitting further forward (towards the front side), the maximum extent of a shelf between the retaining wall block and retaining wall blocks in the lower course is reduced. Correspondingly, the upper block being brought forward will slightly overhang the lower blocks at the location of the upper block's corners. In this way, greater visual smoothness at curves of retaining walls made with planar-faced blocks can be achieved, as will be described.

Figure 1:
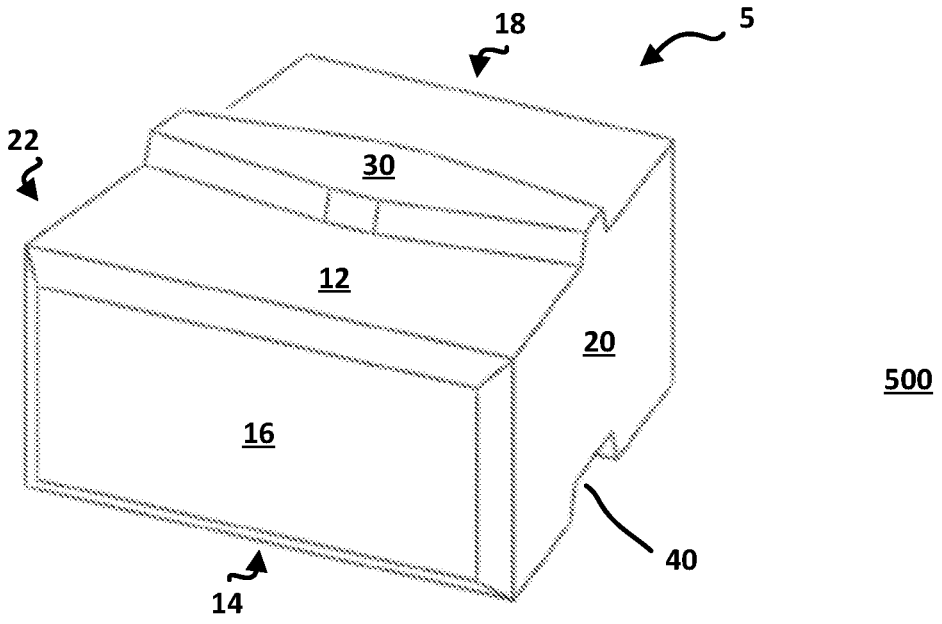
(Prior Art) Fig. 1
FIG. 1 is a top perspective view of a prior art trapezoidal retaining wall block.

Certain aspects and observations regarding the prior art is described herein to provide context for the novel and inventive configurations of retaining wall blocks introduced herein. For example, FIG. 1 is a top perspective view of a prior art trapezoidal retaining wall block 5, such as that shown in the '456 patent. Block 5 has a block body with a top side 12 and a bottom side 14 parallel to the top side 12. Top side 12 and bottom side 14 are trapezoidal in shape and are symmetrical with respect to a central vertical plane CVP (not shown in FIG. 1) through the midline of the block 5. A front side 16 and a rear side 18 of the block body are parallel to each other and, in this description, front side 16 has the larger face than rear side 18. A right side 20 and left side 22 of the block body each extend from front side 16 to rear side 18. In this embodiment, edges of at least front side 16 and rear side 18 are bevelled.

Figure 2:
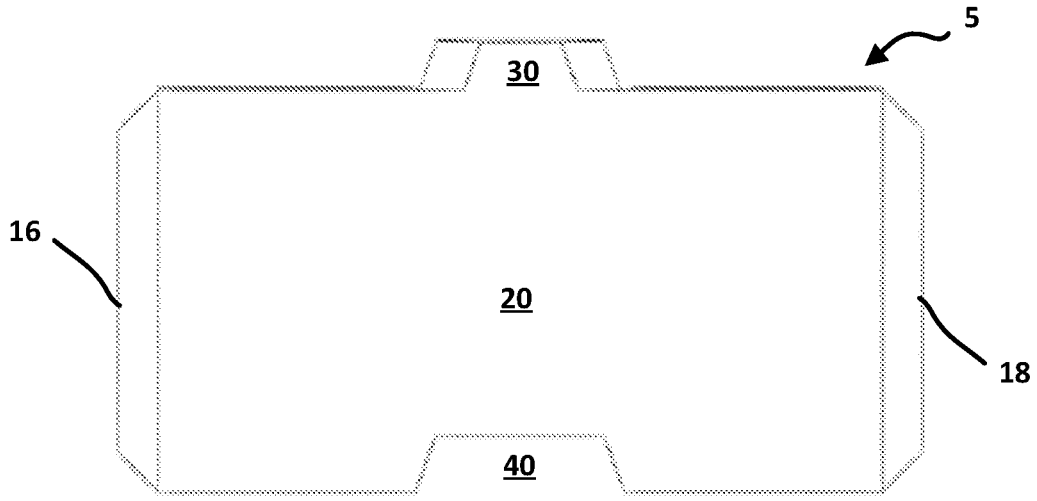
(Prior Art) Fig. 2
FIG. 2 is a right side elevation view of the retaining wall block of FIG. 1.
Figure 3:
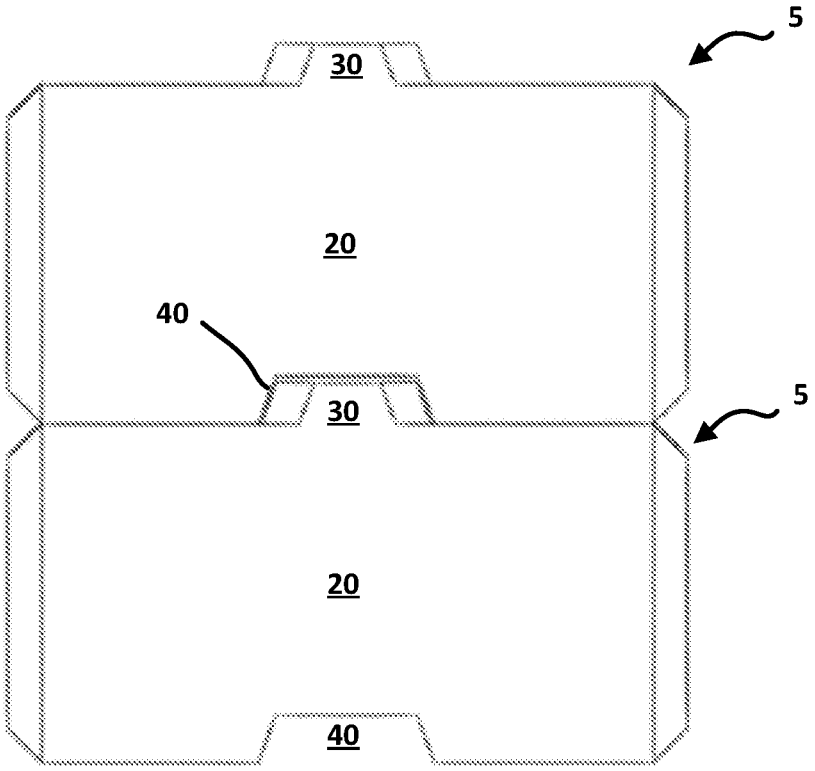
(Prior Art) Fig. 3
FIG. 3 is a right side elevation view of two of the retaining wall block of FIG. 1 stacked together in a straight wall configuration.

The prior art trapezoidal retaining wall block 5 also has an integral tongue 30 extending along top side 12 between left side 22 and right side 20, and a groove 40 extending along bottom side 14 between left side 22 and right side 20. Tongue 30 is shaped a somewhat of a "diamond", whereby a maximum tongue width at its midpoint (corresponding to the midpoint of block 5) is smaller than or equal to the width of groove 40, and its width becomes smaller towards both left side 22 and right side 20. Tongue 30 has this configuration in order to enable it to be received within respective grooves 40 of like blocks in higher courses of a retaining wall, whether or not the like blocks are stacked in a straight configuration or stacked in a curved configuration. FIG. 2 is a right side elevation view of retaining wall block 5, and FIG. 3 is a right side elevation view of two of retaining wall blocks 5 stacked together in a straight wall configuration. It will be appreciated that both tongue 30 and groove 40 have walls that are slightly angled with respect to the vertical for ease of relative placement and formation through molding.

Figure 4:
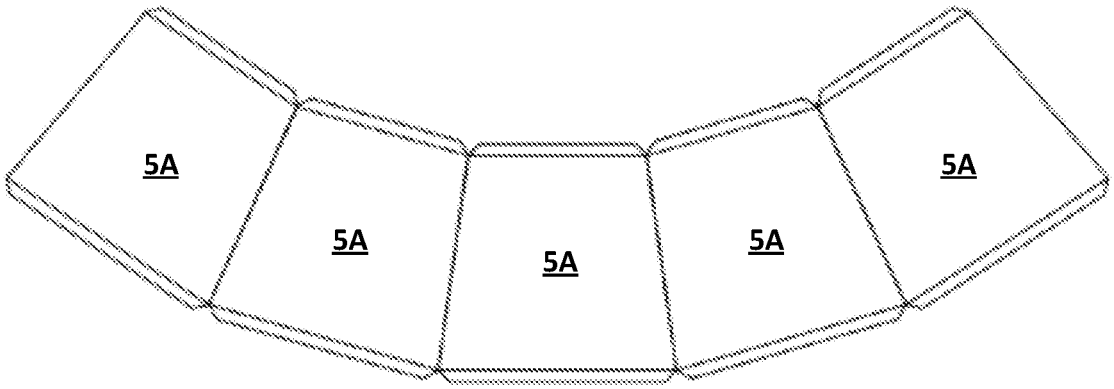
(Prior Art) Fig. 4
FIG. 4 is a top plan view of coping type trapezoidal retaining wall blocks arranged in a curve.

FIG. 4 is a top plan view of coping type trapezoidal retaining wall blocks 5A arranged in a curve. Coping type retaining wall blocks 5A are each the same as retaining wall block 5, except that coping type retaining wall blocks 5A do not themselves have keys 30. The coping type retaining wall blocks 5A are shown for the purpose of illustrating how curved walls can be formed with trapezoidal blocks.

Figure 5:
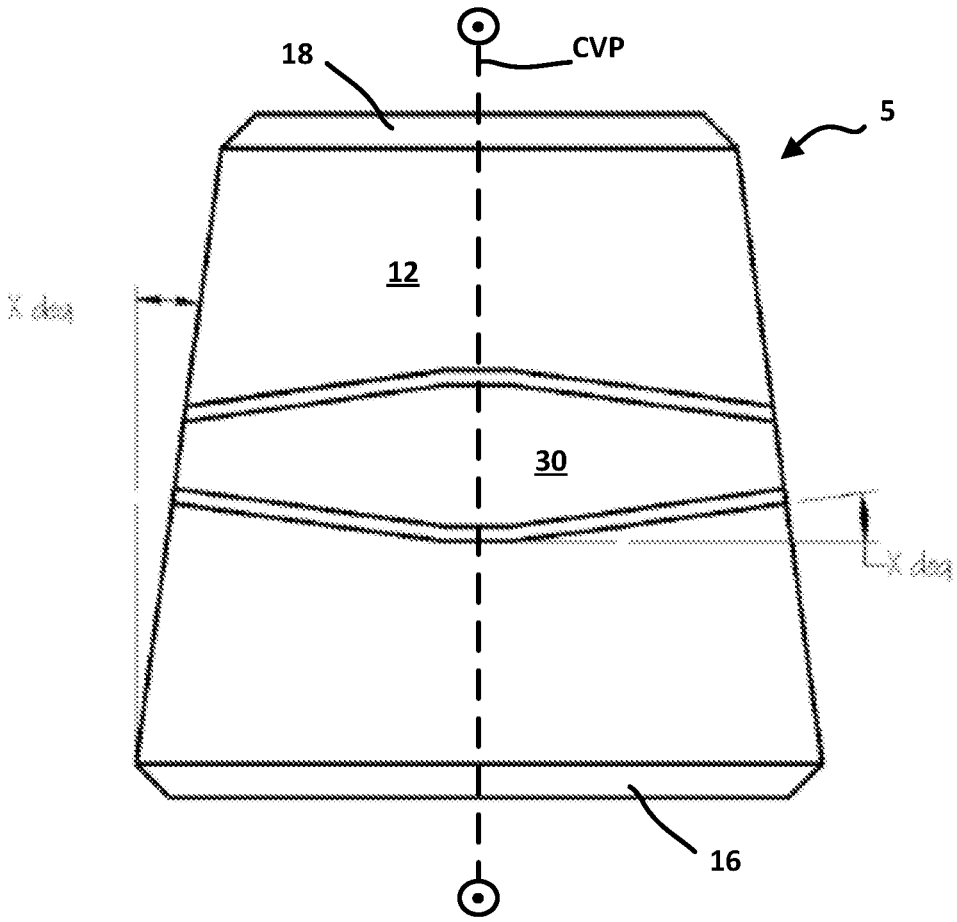
(Prior Art) Fig. 5
FIG. 5 is a top plan view of the retaining wall block of FIG. 1, showing angles of taper of a tongue, or key, of the retaining wall block.

FIG. 5 is a top plan view of retaining wall block 5, showing that an angle of X degrees at which key 30 tapers in either direction corresponds to the angle of the trapezoid shape. In particular, the difference in width between front face 16 and rear face 18 causes left side 22 and right side 20 to each extend from front face 16 to rear face 18 at an angle +/−X degrees with respect to central vertical plane CVP. Central vertical plane CVP is a plane passing through the centre of block 5 into the page as shown, at the midpoint of block 5. Key 30 is correspondingly tapered such that it provides flanking front-facing walls that are offset from the angle of front side 16 by X degrees, as well as a central front-facing wall that is parallel to front side 16. Similarly, key 30 is tapered such that it provides flanking rear-facing walls that are offset from the angle of rear side 18 by X degrees, as well as a central rear-facing wall that is parallel to rear side 18. Like the rest of block 5, key 30 is mirrored about central vertical plane CVP such that it has a left segment and a right segment that are mirror images of each other about central vertical plane CVP.

Figure 6:
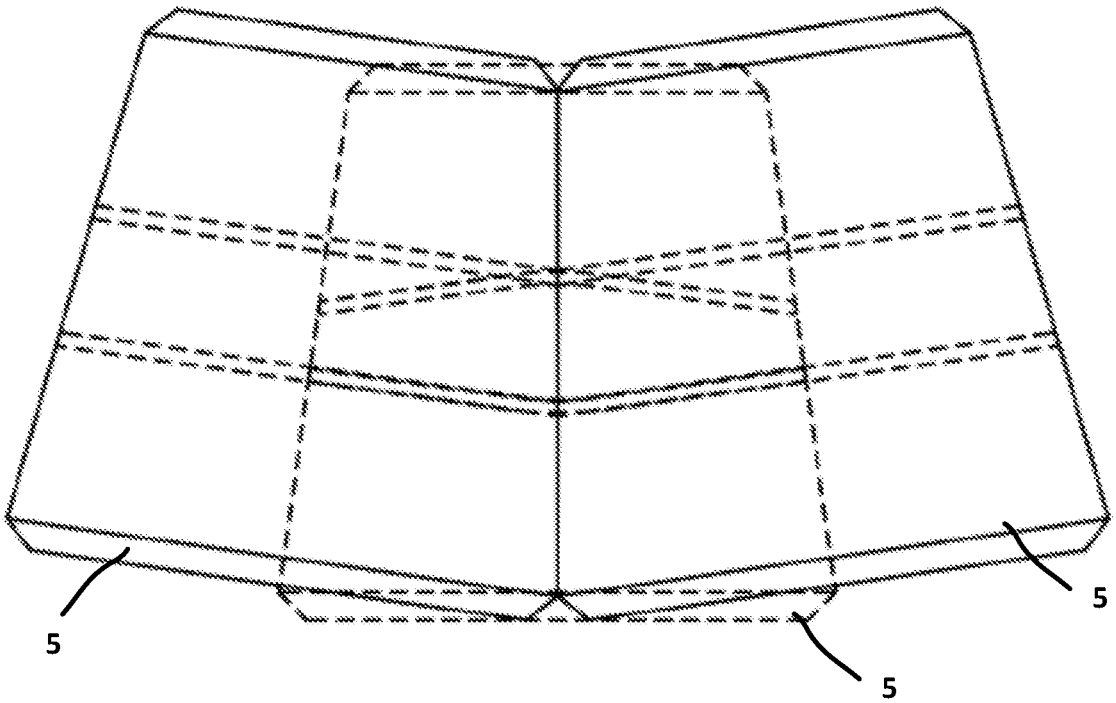
(Prior Art) Fig. 6
FIG. 6 is a top plan view of grooves of two of the retaining wall block of FIG. 1 along a course of a curved wall interfacing with a key of another of the retaining wall block of FIG. 1 along a lower course of the curved wall.

FIG. 6 is a top plan view of grooves 40 of two retaining wall blocks 5 along a course of a curved wall interfacing with a key 30 of another like retaining wall block 5 along a lower course of the curved wall. The upper course blocks 5 are shown primarily in solid lines, with respective downward-facing grooves 40 shown in dashed lines and their respective keys 30 not shown, and the lower course block 5 and its own key 30 are shown entirely in dashed lines. It can be seen that, because blocks 5 have planar faces at their front sides 16 and their rear-sides 18, the lower course block 5 maximally protrudes underneath the front faces of the upper course blocks 5 at about the midpoints of their front (wider) sides 16 and the upper course blocks 5 overhang the rear face of the lower course block 5 at about the left and right sides of its rear (narrower) side 18.

Figure 7:
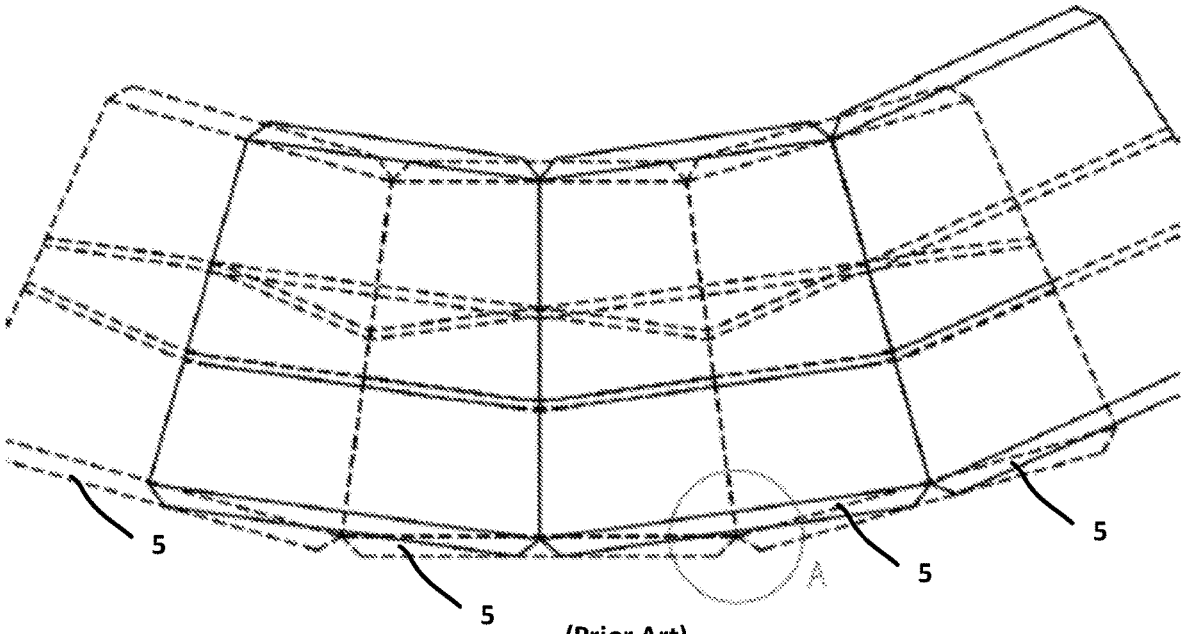
(Prior Art) Fig. 7
FIG. 7 is a top plan view of the grooves of several of the retaining wall block of FIG. 1 along a course of a curved wall interfacing with the keys of other retaining wall blocks along a lower course of the curved wall.
Figure 7A:
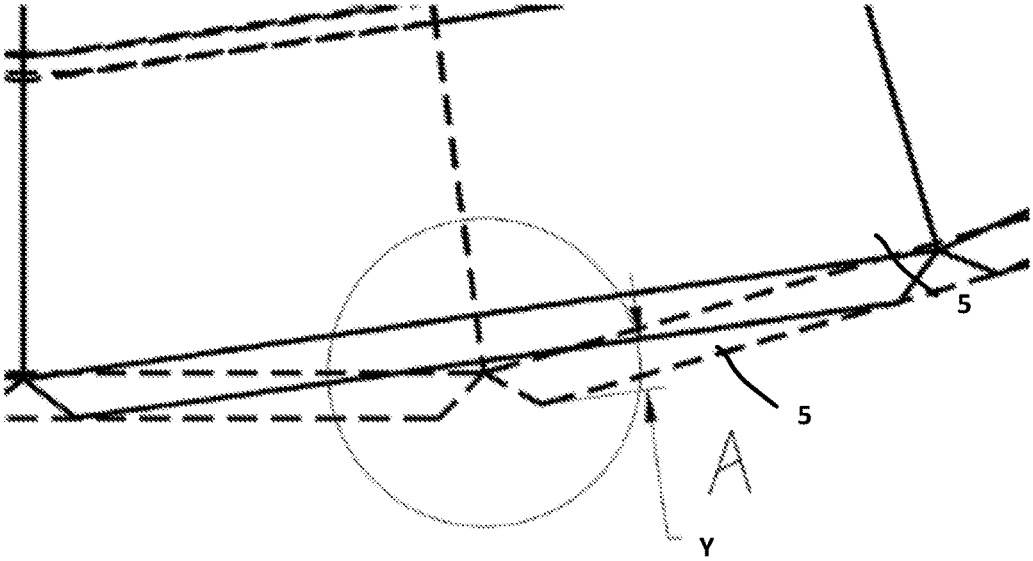
(Prior Art) Fig. 7A
FIG. 7A is a magnified partial top plan view showing an extent to which a course of retaining wall blocks in the curved wall of FIG. 7 protrude outwards from the face of the wall with respect to the course above it.

FIG. 7 is a top plan view of the grooves 40 of several of retaining wall blocks 5 along a course of a curved wall interfacing with the keys 30 of other retaining wall blocks 5 along a lower course of the curved wall. A section 'A' at the midpoint of a retaining wall block 5 on the upper course identifies where the shelf formed by blocks 5 on the lower course has its maximum extent, ameliorated only slightly by the slightly beveled front side 16. FIG. 7A is a magnified partial top plan view of a portion of FIG. 7, showing the maximum extent Y at this midpoint of the upper block 5.

Figure 8:
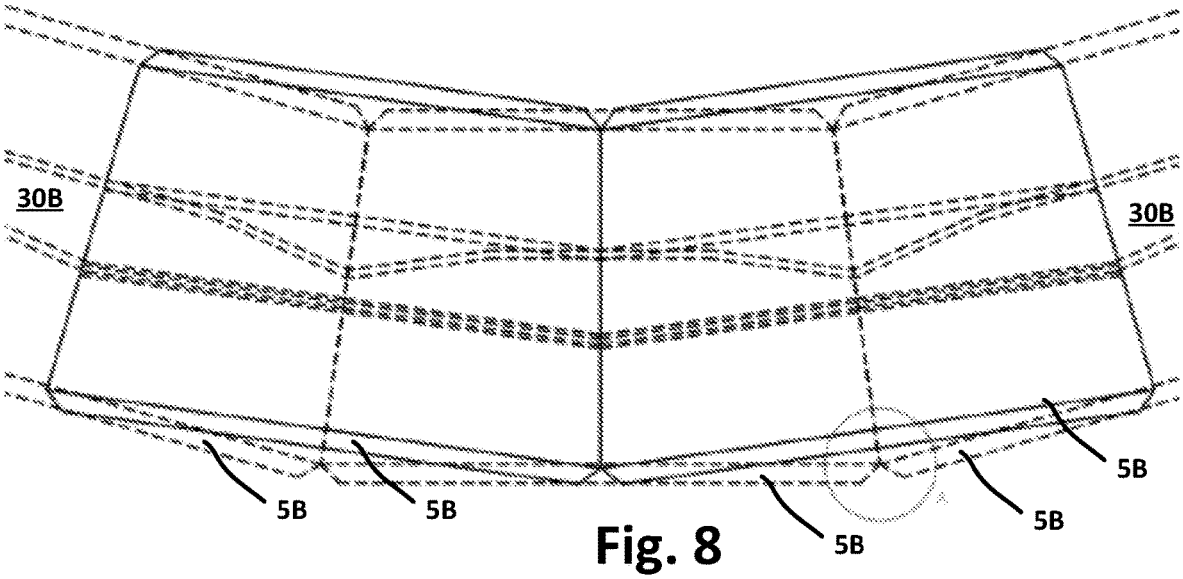
FIG. 8 is a top plan view of the grooves of several of retaining wall blocks having wider front and rear faces than the retaining wall block of FIG. 1 along a course of a curved wall interfacing with the keys of other like retaining wall blocks along a lower course of the curved wall.
Figure 8A:
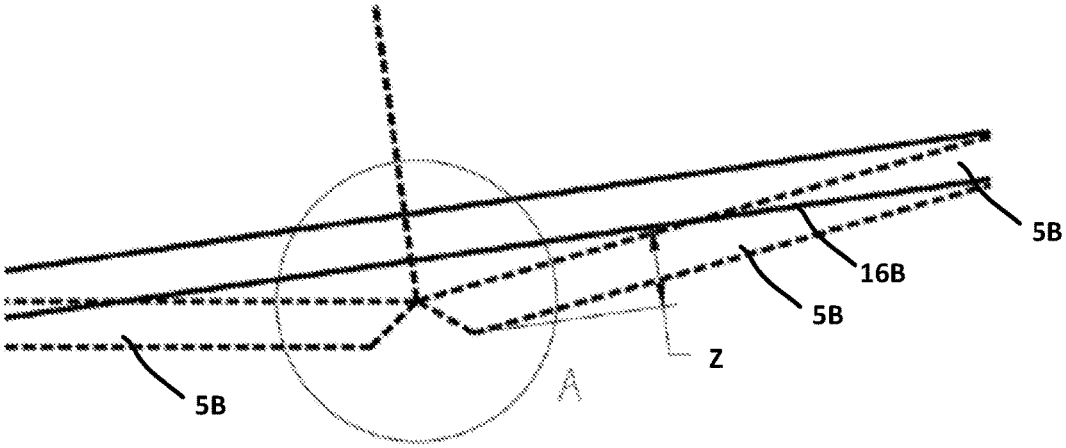
FIG. 8A is a magnified partial top plan view showing an extent to which a course of retaining wall blocks in the curved wall of FIG. 8 protrude outwards from the face of the wall with respect to the course above it.
Figure 8B:
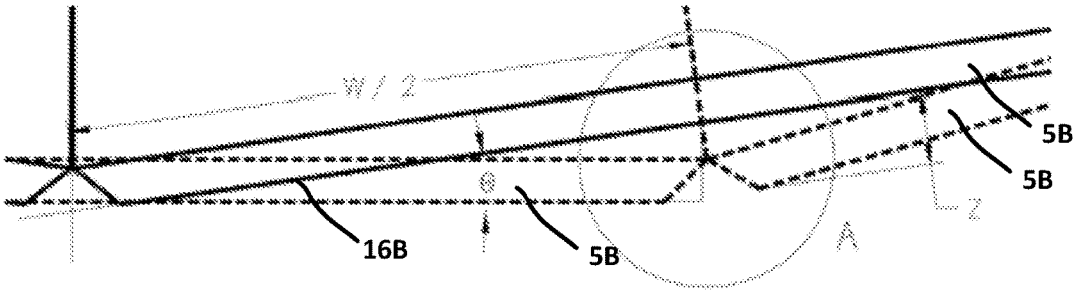
FIG. 8B is another magnified partial top plan view showing an extent to which a course of retaining wall blocks in the curved wall of FIG. 8 protrude outwards from the face of the wall with respect to the course above it.

FIG. 8 is a top plan view of the grooves of several of retaining wall blocks 5B having wider front and rear faces than the retaining wall block 5 of FIG. 1 along a course of a curved wall interfacing with the keys 30B of other like retaining wall blocks 5B along a lower course of the curved wall. A section 'A' at the midpoint of a retaining wall block 5B on the upper course illustrates where the shelf formed by blocks 5B on the lower course has its maximum extent, ameliorated only slightly by the slightly beveled front side 16B. FIG. 8A is a magnified partial top plan view of a portion of FIG. 8, showing a maximum extent Z at this midpoint of the upper block 5B. FIG. 8B is another magnified partial top plan view of a portion of FIG. 8, showing the maximum extent Z, the angle θ of the trapezoidal shape with respect to the front side 16B of the uppermost block 5B, and half of the width W/2 (the full width being W) across the front side 16 of the uppermost block. Because blocks 5B have significantly wider front faces than blocks 5 relative to the radius of the curve of the wall, the maximum extent Z in curved walls formed with blocks 5B is accordingly much larger than the maximum extent Y in the curved walls formed with blocks 5, and gives the curves a choppy or disjointed appearance due to its size. This maximum extent Z can be approximated according to Equation 1 below:

$$Z=W/2\times\tan(\theta) \quad (1)$$

Figure 9:
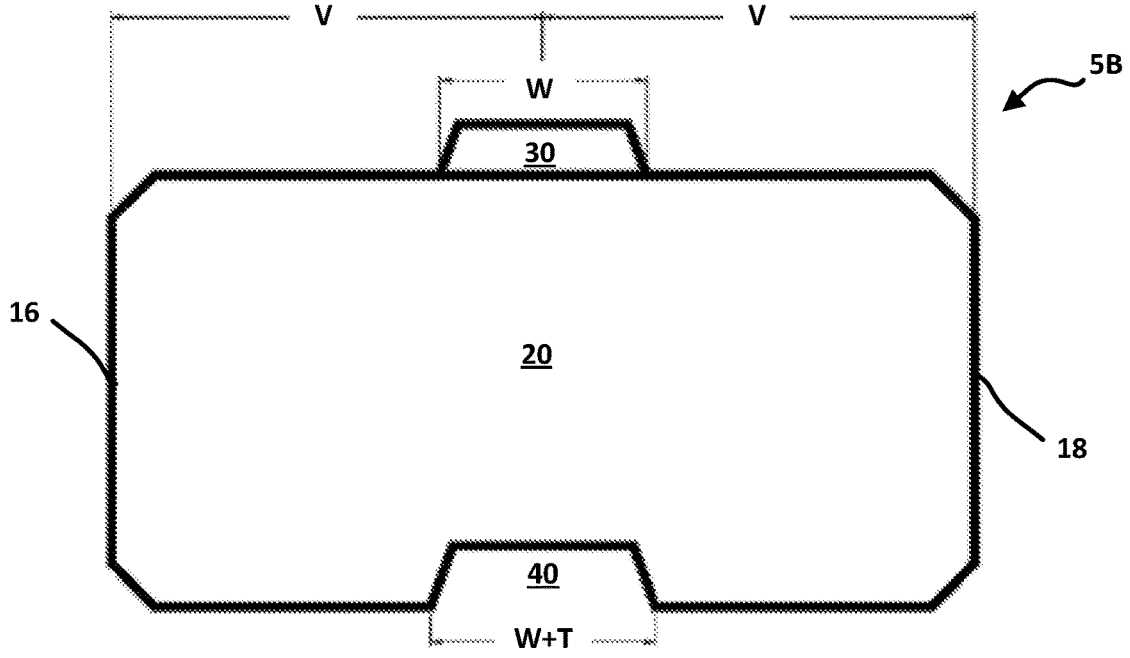
(Prior Art) Fig. 9
FIG. 9 is another right side elevation view of the retaining wall block of FIG. 1, showing relative front-back positioning of the key and the groove.

It has been found that relative positioning of key 30 and groove 40, when groove includes a width corresponding to key 30 but is slightly wider by a tolerance value, factors into whether the wall being build with such blocks 5 is "over-vertical". FIG. 9 is another right side elevation view of retaining wall block 5, showing relative front-back positioning and sizing of the key 30 and the groove 40. Key 30 is centred at the midpoint between front side 16 and rear side 18, in that the distance V from the middle of key 30 to rear side 18 is the same as the distance V from front side 16 to the middle of key 30. Furthermore, key 30 has a maximum width of W. Similarly, groove 40 is centred at the midpoint between front side 16 and rear side 18. In addition, groove 40 has a width of W+T, with T representing a tolerance amount that is allowed for in the manufacturing process and to ensure a key 30 can always fit easily within a groove 40.

Figure 10:
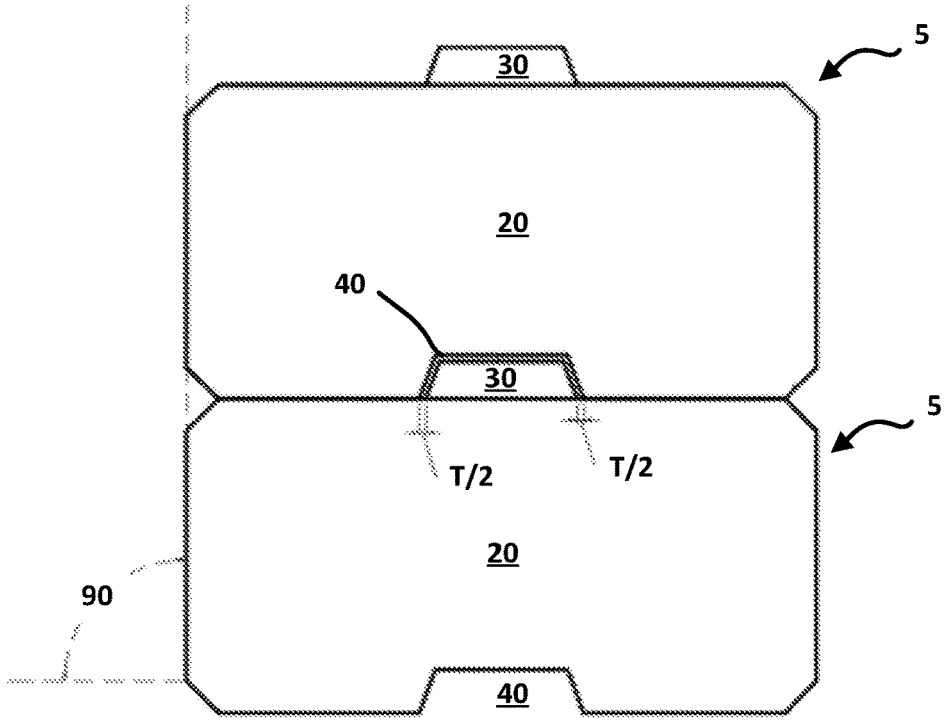
(Prior Art) Fig. 10
FIG. 10 is a right side elevation view of two of the retaining wall block of FIG. 1 stacked together, showing relative front-back positioning of the key and the groove.
Figure 11:
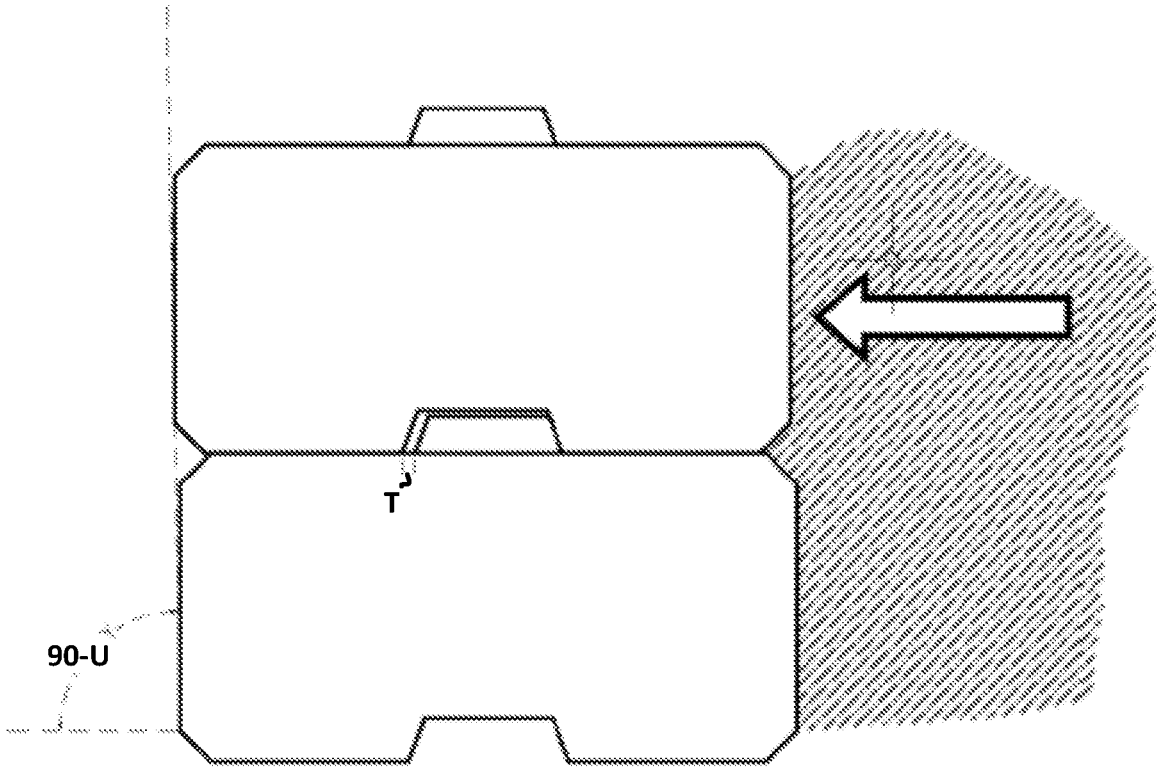
(Prior Art) Fig. 11
FIG. 11 is a right side elevation view of two of the retaining wall block of FIG. 1 stacked together, showing relative front-back positioning of the key and the groove as the uppermost retaining wall block is urged frontwards with respect to the lowermost retaining wall block by the force of earth being retained.

FIG. 10 is a right side elevation view of two retaining wall blocks 5 stacked together, showing relative front-back positioning of key 30 and groove 40. If blocks 5 were to be stacked vertically with no lateral pressure, it would be possible to maintain a 90-degree wall face, such that there was no lean outwards. However, as shown in FIG. 11, due to lateral pressure from material being retained by the wall, the uppermost block 5 is urged forward such that the entire tolerance T is frontwards of the lowermost key 30, with no tolerance T rearwards of the lowermost key 30. As such, the uppermost block 5 leans slightly outwards (leftwards in FIG. 11), with this outward lean accumulating over multiple courses. Despite the tolerance T tending to be small, this accumulated outward lean makes the wall face "over-vertical", which tends to be unappealing.

FIG. 11 is a right side elevation view of two retaining wall blocks 5 stacked together, showing relative front-back positioning of the key and the groove as the uppermost retaining wall block 5 is being urged frontwards with respect to the lowermost retaining wall block by the forced of earth being retained.

Figure 12:
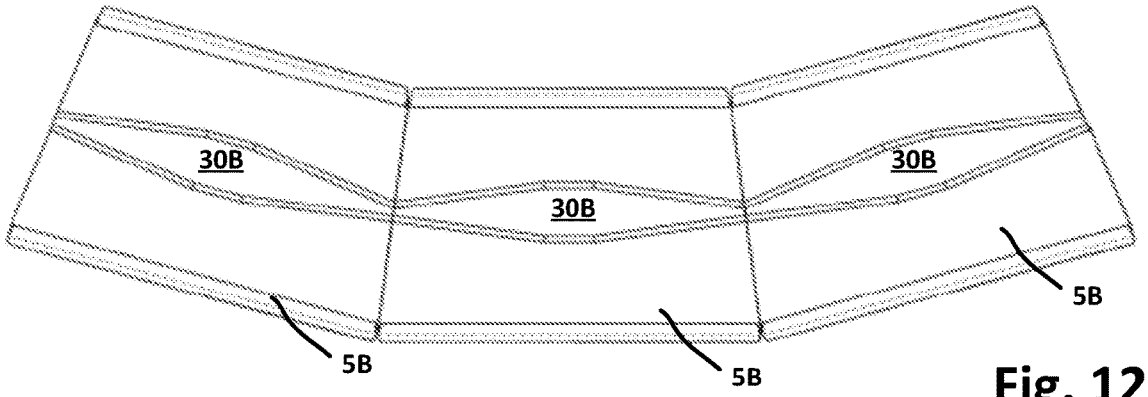
FIG. 12 is a top plan view of trapezoidal retaining wall blocks arranged in a curve.
Figure 13:
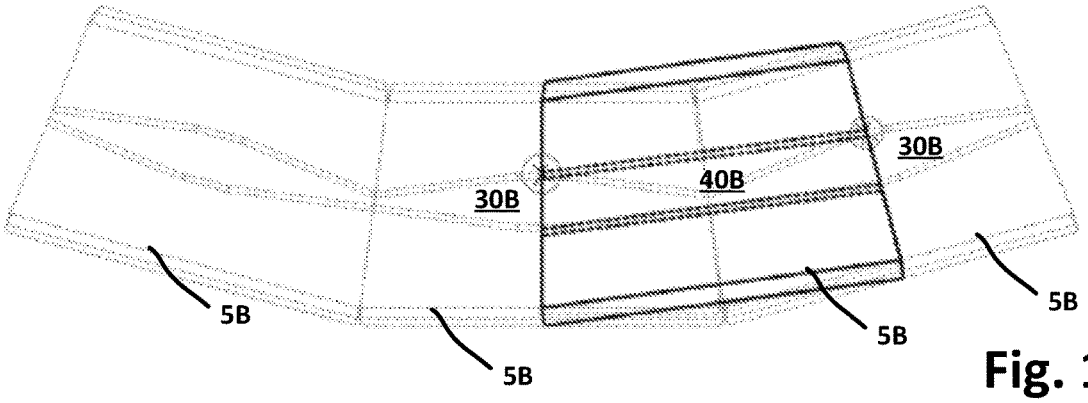
FIG. 13 is a top plan view of keys of two of the retaining wall blocks of FIG. 12 along a course of a curved wall interfacing with a groove of another of the retaining wall blocks on an upper course of the curved wall.
Figure 13A:
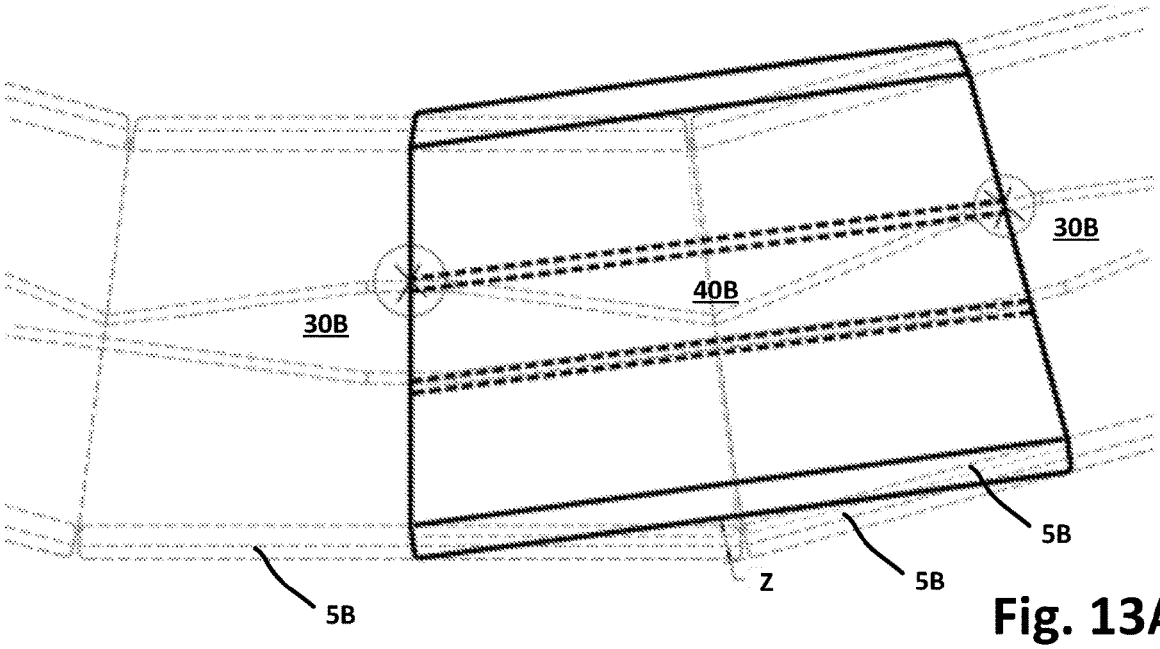
FIG. 13A is a magnified top plan view of keys of two of the retaining wall blocks of FIG. 12 along a course of a curved wall interfacing with a groove of another of the retaining wall blocks in an upper course of the curved wall.

FIG. 12 is a top plan view of trapezoidal retaining wall blocks 5B arranged in a curve. FIG. 13 is a top plan view of keys 30B of two of the retaining wall blocks 5B along a course of a curved wall interfacing with groove 40B of another of the retaining wall blocks 5B in an upper course of the curved wall. FIG. 13A is a magnified top plan view of keys 30B of two retaining wall blocks 5B along a course of a curved wall interfacing with a groove 40B of another of retaining wall blocks 5B in a subsequent course of the curved wall. Shown with circles are points X at which groove 40B contacts the midpoints of keys 30B of two adjacent lower course blocks 5B. The two contact points X dictate the position of the front side 16 of the upper course.

Figure 14:
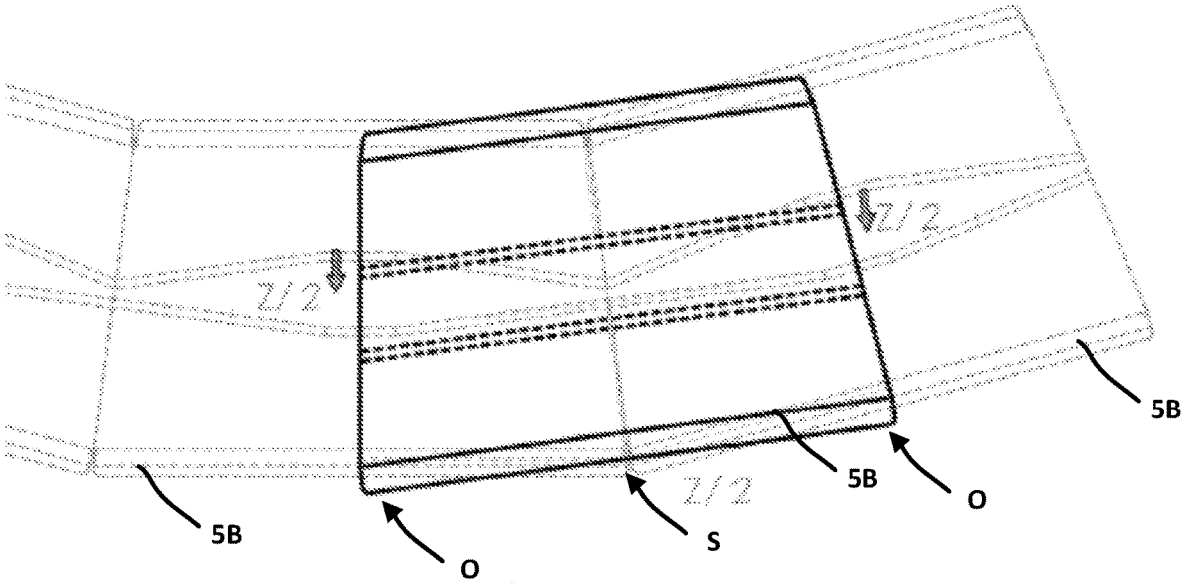
FIG. 14 is a top plan view of the conceptual shifting-forward of the retaining wall block along the upper course of the curved wall of FIG. 13, with respect to lower course blocks.

FIG. 14 is a top plan view of the conceptual shifting-forward of the retaining wall block 5B along the upper course of the curved wall of FIG. 13, with respect to the lower course blocks 5B, according to a novel and inventive embodiment. In this figure, the shift forward is an amount of Z/2 with respect to the lower course blocks. The direction of the shifting forward is along the central vertical plane CVP (not shown in FIG. 14). In this way, the maximum extent of the shelf S underlying the front face 16B of retaining wall block 5B is halved, with the difference being taken up by newly-formed front overhangs O. The visual discontinuities are thus individually reduced and spread somewhat evenly amongst small overhangs O and small shelves S, rather than manifesting entirely as large shelves when seen from the front. This thereby enables the resultant wall to appear smoother through the curves despite being formed with blocks whose faces are wide relative to the curve radius.

Figure 15:
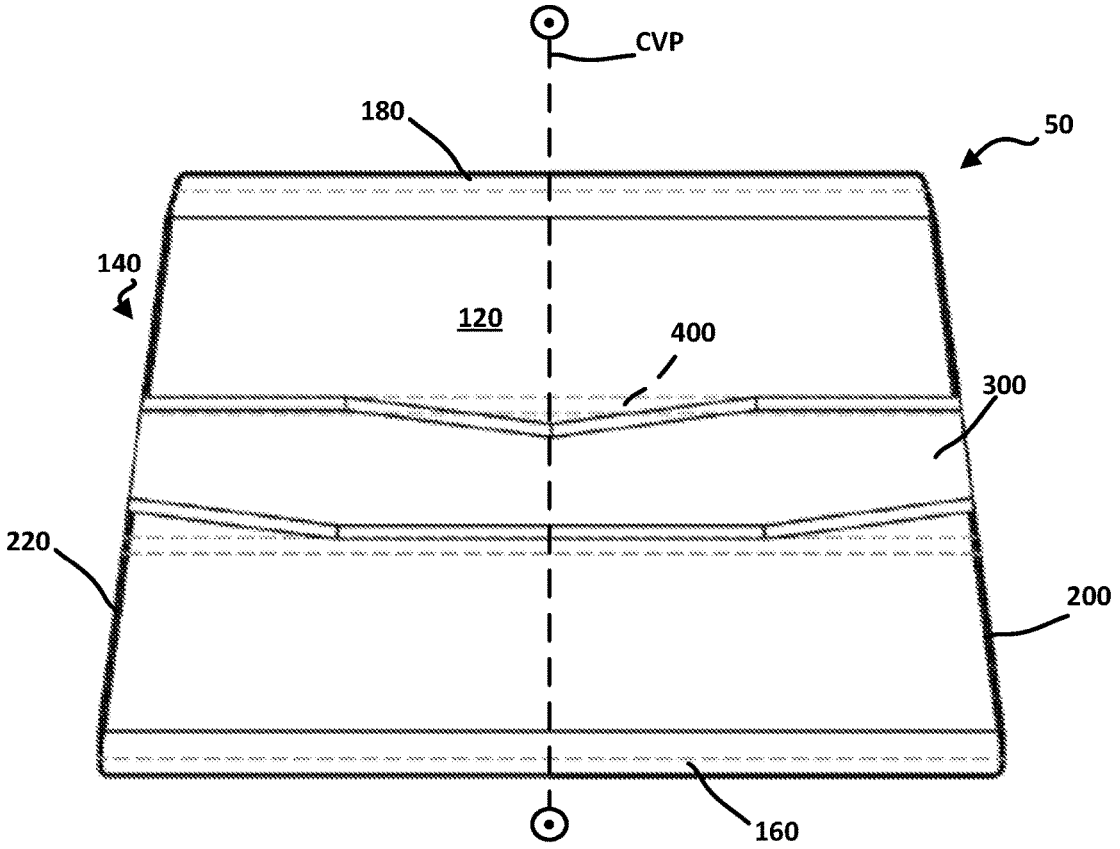
FIG. 15 is a top plan view of a trapezoidal retaining wall block having a key shaped to accommodate the shifting forward illustrated in FIG. 14 while interlocking with the groove of a like retaining wall block in the subsequent course, according to an embodiment.

In this description, to enable blocks to overlie each other in the manner suggested by FIG. 14 while providing sufficient interlocking that is also useful when building straight walls, an unique vertical interlock system is provided. FIG. 15 is a top plan view of a trapezoidal retaining wall block 50 having a key 300 that is shaped to accommodate the shifting forward explained above in connection with FIG. 14, while also interlocking with a groove 400 of a like retaining wall block 50 in the subsequent course, according to an embodiment.

Retaining wall block 50 has a block body which includes a top side 120 and a bottom side 140 that is parallel to top side 120. Each of top side 120 and bottom side 140 is trapezoidal in shape and is symmetrical with respect to a central vertical plane CVP. The block body also has a front side 160 and a rear side 180 that is parallel to front side 160, as well as a right side 200 and a left side 220 opposite right side 200.

A vertical interlock system of retaining wall block 50 includes a groove 400 (shown in dashed lines in FIG. 15 but not normally visible from a top plan view) and a key 300. Groove 400 has a given groove width and a given groove depth and has walls that are, in this embodiment, just slightly angled with respect to the vertical (into the page) for ease of insertion of a key 300 as well as for ease of manufacturing. Groove 400 extends transverse to central vertical plane CVP along bottom side 140 from left side 220 to right side 200 and is therefore open through from left side 220 to right side 200 as well as open on bottom side 140. Key 300 of the vertical interlock system extends transverse to central vertical plane CVP along top side 120 and has a maximum key width that is smaller than or equal to the given groove width, so it may be received within a groove 400 of another like block 50. Similarly, key 300 has a maximum key height that is smaller than or equal to the given groove height.

Key 300 has a left side portion (the portion of key 300 to the left of central vertical plane CVP in FIG. 15) and key 300 has a right side portion (the portion of key 300 to the right of central vertical plane CVP in FIG. 15). The left side portion of key 300 is shaped to reduce in width towards both left side 220 and right side 200. Similarly, the right side portion of key 300 is also shaped to reduce in width towards both left side 140 and right side 200. Therefore, key 300 has two wide areas and three narrow areas.

In this embodiment, both the right side portion and the left side portion of key 300 have a maximum width that is the same as the width of groove 400, taking into account groove 400 being slightly wider by a small tolerance amount. Furthermore, each of key 300 and groove 400 is bevelled—at an angle with respect to the vertical—for ease of manufacture and use.

Figure 16:
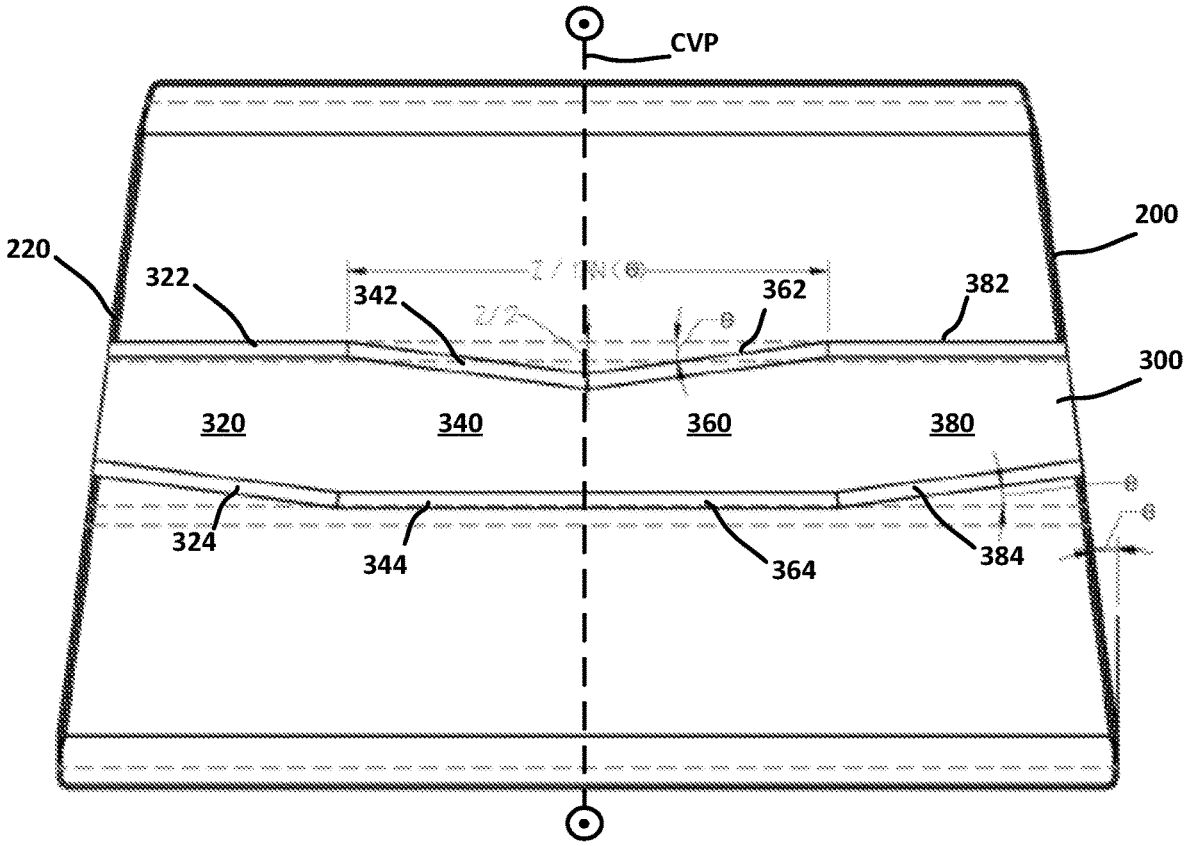
FIG. 16 is a top plan view of the trapezoidal retaining wall block of FIG. 15, identifying angles and extents of rear and front-facing surfaces of the key.

FIG. 16 is a top plan view of trapezoidal retaining wall block 50, identifying angles and extents of rear and front-facing walls of key 300. In this embodiment, key 300 has a first segment 320, a second segment 340, a third segment 360 and a fourth segment 380. In this embodiment, segments 320, 340, 360, 380 are all contiguous and formed as one key 300. However key 300 is referred-to herein in segments for the purpose of describing features of key 300, as well as for describing alternatives to key 300. First segment 320 and second segment 340 are part of the left side portion of key 300, with second segment 240 being between first segment 320 and central vertical plane CVP. Third segment 360 and fourth segment 380 are part of the right side portion of key 300, with third segment 360 being between central vertical plane CVP and fourth segment 380.

First segment 320 has a rear-facing wall 322 that is normal to central vertical plane CVP and a front-facing wall segment 324 that is normal to left side 220. Second segment 340 has a rear-facing wall 342 that is normal to left side 220 and a front-facing wall that is normal to central vertical plane CVP. Third segment has a rear-facing wall 362 that is normal to right side 200 and a front-facing wall 364 that is normal to central-vertical plane CVP. Fourth segment 380 has a rear-facing wall 382 that is normal to central vertical plane CVP and a front-facing wall 384 that is normal to right side 200.

In this embodiment, rear-facing wall 322 meets rear-facing wall 342 at halfway between left side 220 and central vertical plane CVP, rear-facing wall 342 meets rear-facing wall 362 at central vertical plane CVP, and rear-facing wall 362 meets rear-facing wall 382 at halfway between right side 200 and central vertical plane CVP. Furthermore, front-facing wall 324 meets front-facing wall 344 at halfway between left side 220 and central vertical plane CVP, front-facing wall 344 meets front-facing wall 364 at central vertical plane CVP, and front-facing wall 364 meets front-facing wall 384 at halfway between right side 200 and central vertical plane CVP. This meeting of walls at halfway (or at about this location allowing for some tolerance), enables another like block 50 in a subsequent course to be shifted forward in the amount of Z/2. Meeting of rear-facing/front-facing walls closer to the left and right sides 220, 200 while maintaining the maximum width of key 300 would result in shifting block 50 in a subsequent course more than Z/2, and meeting closer to central vertical plane CVP would result in shifting block 50 in a subsequent course forward less than Z/2.

Key 300 may alternatively be regarded as having a rear-facing wall and a front-facing wall, comprised of respective wall segments. For example, key 300 includes a first rear-facing wall segment 322 and a fourth rear-facing wall segment 382 that are both normal to central vertical plane CVP and that together flank a second rear-facing wall segment 342 and a third rear-facing wall segment 362. The second rear-facing wall segment 342 and the third rear-facing wall segment 362 are normal to the left side 220 and to the right side 200 respectively. Similarly, key 300 also includes first and fourth front-facing wall segments 324 and 384 that are normal to the left side 220 and the right side 200 respectively and that together flank a second front-facing wall segment 344 and a third front-facing wall segment 364 that are both normal to central vertical plane CVP. In this embodiment, the wall segments 322, 342, 362 and 382 are contiguous, and the wall segments 342, 344, 364 and 384 are contiguous. Furthermore, in this embodiment wall segments 322 and 342 meet halfway between left side 220 and central vertical plane CVP, wall segments 324 and 344 meet halfway between left side 220 and central vertical plane CVP, wall segments 342 and 362 meet at central vertical plane CVP, wall segments 344 and 364 meet at central vertical plane CVP, wall segments 362 and 382 meet halfway between central vertical plane CVP and right side 200, and wall segments 364 and 384 meet halfway between central vertical plane CVP and right side 200.

Figure 17:
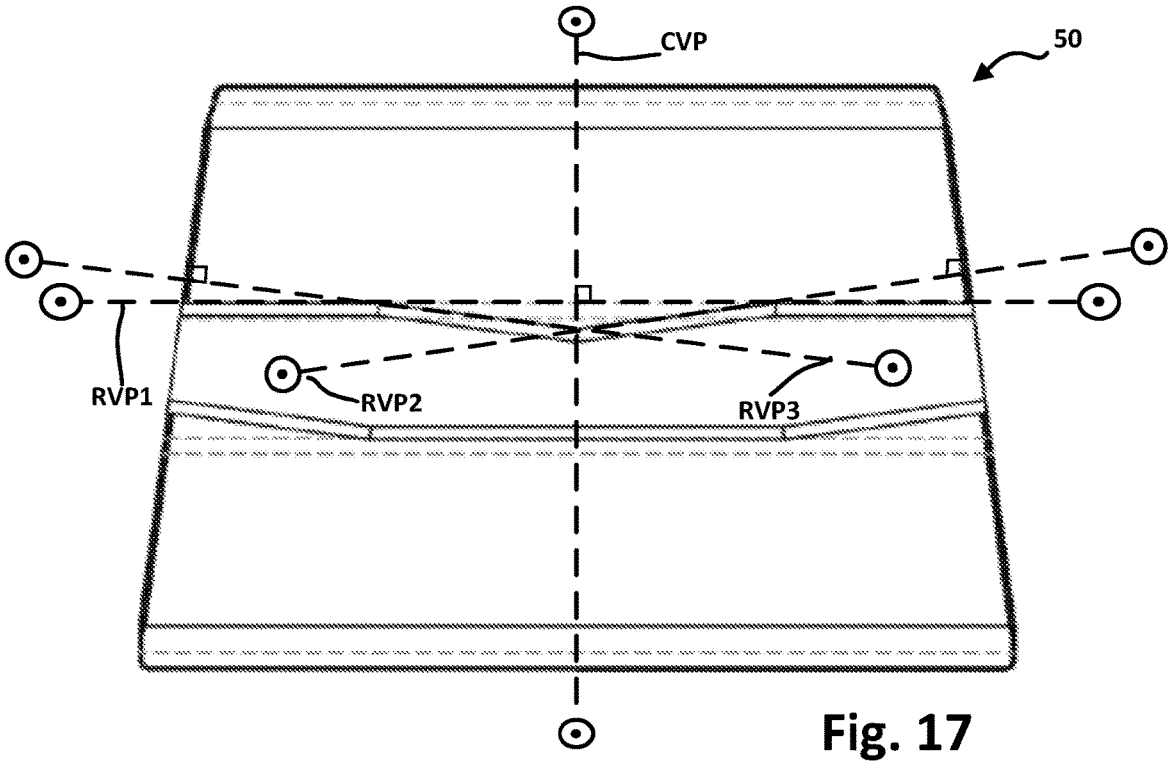
FIG. 17 is a top plan view of the trapezoidal retaining wall block of FIG. 15, showing planes along which front-facing wall segments of the key extend.
Figure 18:
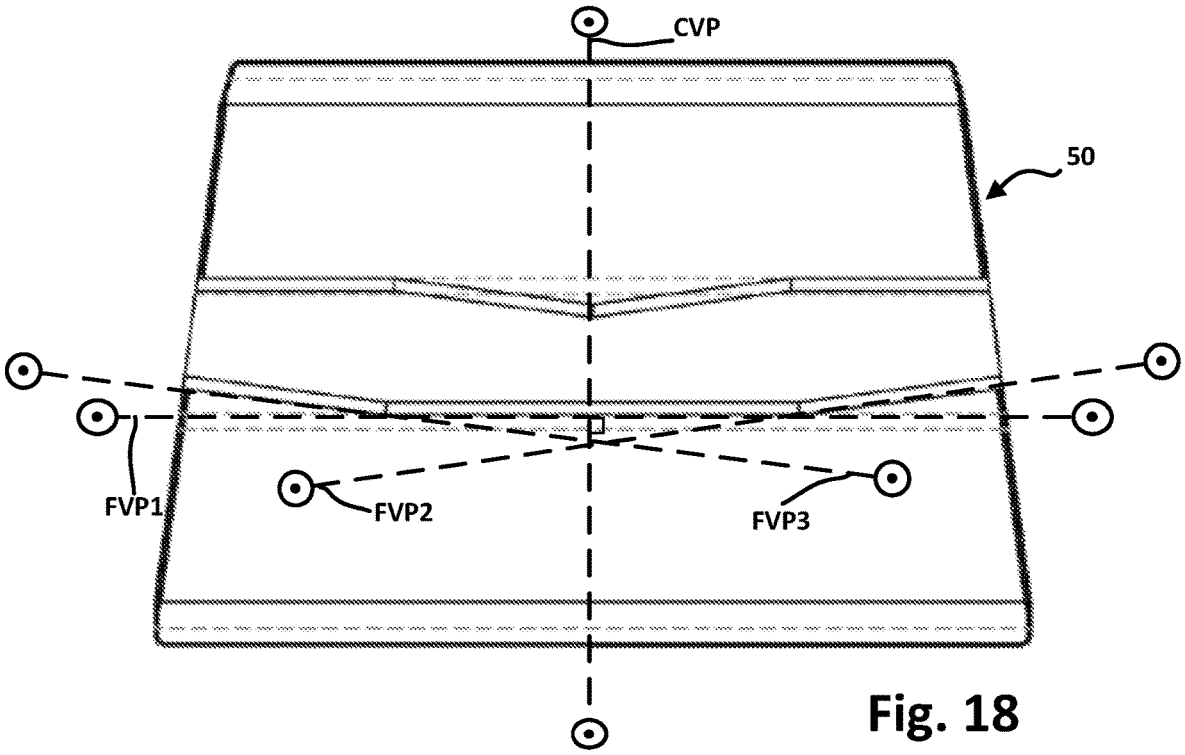
FIG. 18 is a top plan view of the trapezoidal retaining wall block of FIG. 15, showing planes along which rear-facing wall segments of the key extend.

FIG. 17 is a top plan view of trapezoidal retaining wall block 50, showing planes along which rear-facing wall segments of key 300 extend. FIG. 18 is a top plan view of the trapezoidal retaining wall block 50, showing planes along which front-facing wall segments of the key extend. While particular configurations of wall segments that meet, and that meet at the halfway points as described above, are embodied in block 50, variations are possible. As such, it may be more generally observed that a key suitable for achieving the shifting forward described herein should fit within a particular key "envelope" KE and meet a few other constraints, but otherwise does not have to be symmetrical about central vertical plane CVP, does not have to be contiguous, could be made of several discontinuous key segments, and could have different key segments for the front-facing wall and the rear-facing wall of the key. As for constraints, it may be observed that, for shifting forward in the amount of Z/2 as well as providing suitable bearing surfaces against which a groove of a like block in a subsequent course could bear for providing interlock, a first rear vertical plane RVP1 along which first and fourth rear-facing wall segments 322 and 382 extend intersects a second rear vertical plane RVP2 along which second rear-facing wall segment 342 extends halfway between central vertical plane CVP and left side 220 of retaining wall block 50. Furthermore, the first rear vertical plane RVP1 intersects a third rear vertical plane RVP3 along which the third rear-facing wall 362 extends halfway between the first central vertical plane CVP and the right side 200 of retaining wall block 50.

As shown in FIG. 18, where the front-facing wall of key 300 is concerned, a first front vertical plane FVP1 along which second and third front-facing wall segments 344 and 364 extend intersects a second front vertical plane FVP2 along which first front-facing wall segment 324 extends halfway between central vertical plane CVP and left side 220 of retaining wall block 50. Furthermore, the first front vertical plane FVP1 intersects a third front vertical plane FVP3 along which the fourth front-facing wall 384 extends halfway between central vertical plane CVP and right side 200 of retaining wall block 50.

Figure 19A:
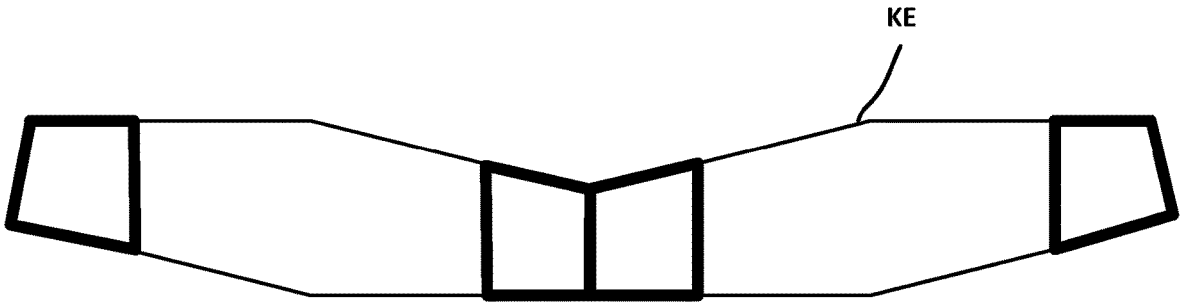
FIGS. 19A, 19B and 19C are top plan views of various alternative key configurations fitting within a key envelope within which the key of the retaining wall block of FIG. 15 also fits.
Figure 19B:
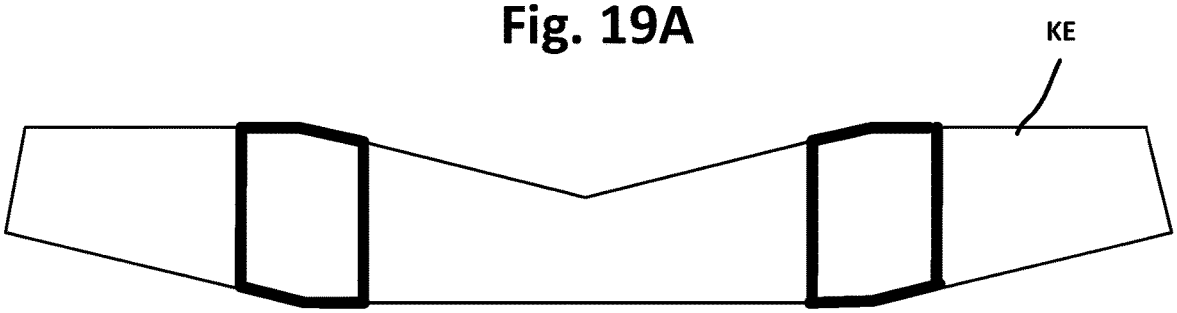
Figure 19C:
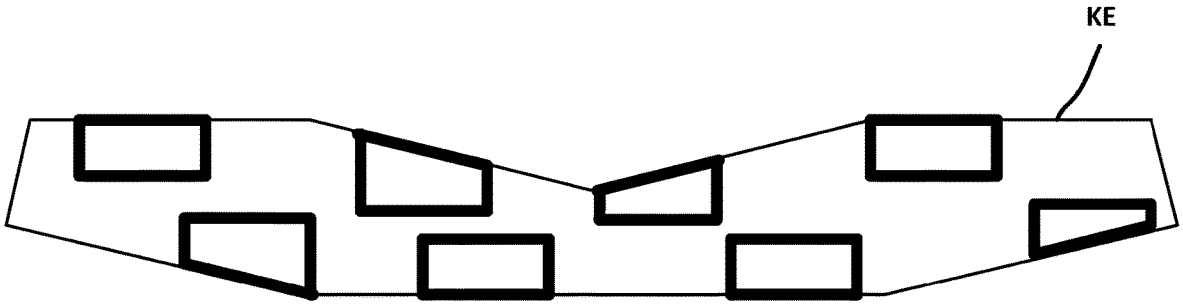

It will be appreciated that various configurations of key, other than key 300, can satisfy these constraints. For example, FIGS. 19A, 19B and 19C are top plan views of various alternative key configurations fitting with a key envelope KE within which key 300 of block 50 also fits. Like key 300, these alternative key configurations provide the Z/2 forward shift, fit within groove 400 in straight and angled configurations, and provide vertical interlocking between courses. Generally-speaking, the key envelope KE corresponds to a shape that can be received within a groove in either straight or angled configurations, and that does not extend beyond the left side 220, right side 200, front side 16 or rear side 18. In each of these figures, alternative key configurations are provided whereby, like key 300, a first rear vertical plane along which first and fourth rear-facing wall segments extend intersects a second rear vertical plane along which a second rear-facing wall segment extends halfway between central vertical plane CVP and the left side of the block. Furthermore, the first rear vertical plane intersects a third rear vertical plane along which a third rear-facing wall extends halfway between the central vertical plane and the right side of the block. Also, where the front-facing wall these alternative keys is concerned, a first front vertical plane along which second and third front-facing wall segments extend intersects a second front vertical plane along which a first front-facing wall segment extends halfway between the central vertical plane and the left side of the block. Furthermore, the first front vertical plane intersects a third front vertical plane along which a fourth front-facing wall extends halfway between the central vertical plane and the right side of the block. The alternatives of FIGS. 19A to 19C are provided to demonstrate that there are various configurations of keys that could notionally be provided to achieve the objects of this description, though it will be appreciated that certain alternative keys may be more or less practical or costly to manufacture, and/or may provide more or less strength, reliability and stability in use than key 300 of block 50.

Figure 20:
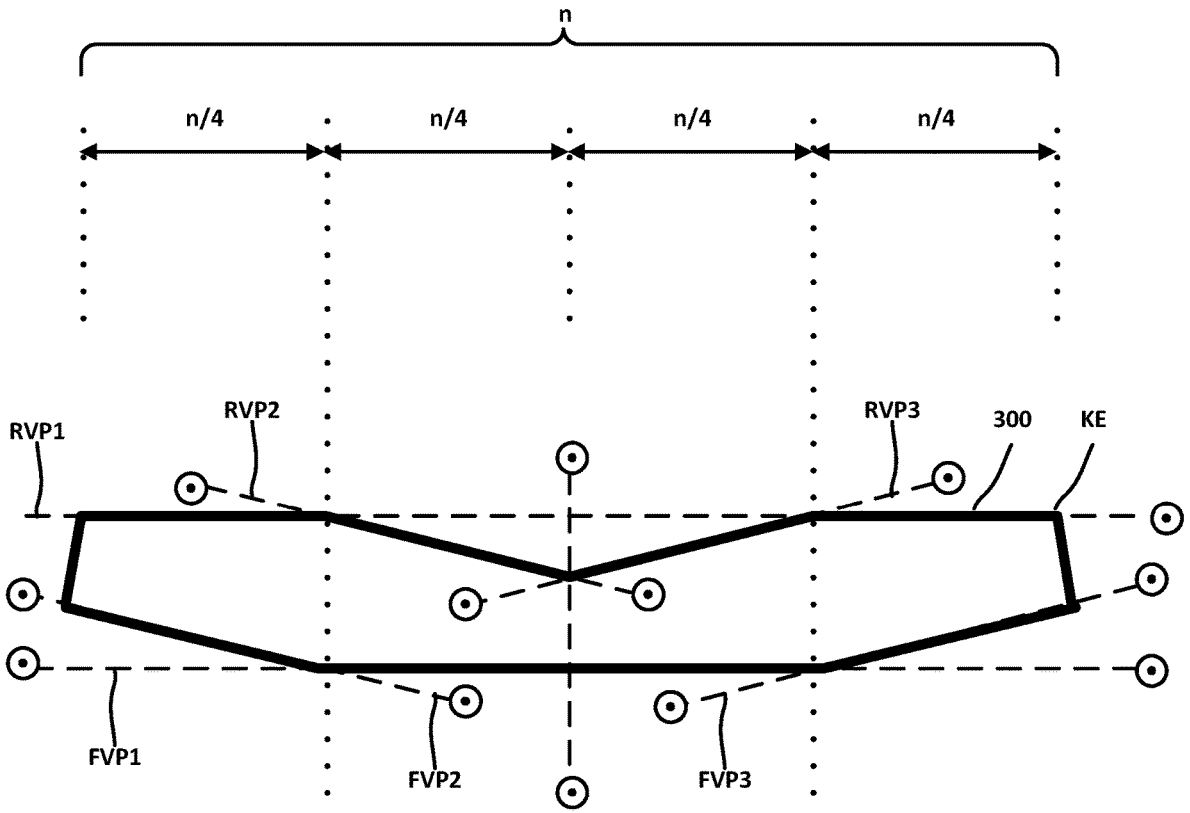
FIG. 20 is a top plan view of the key of the trapezoidal retaining wall block of FIG. 15, in isolation, showing where planes shown in FIGS. 18 and 19 intersect.
Figure 21A:
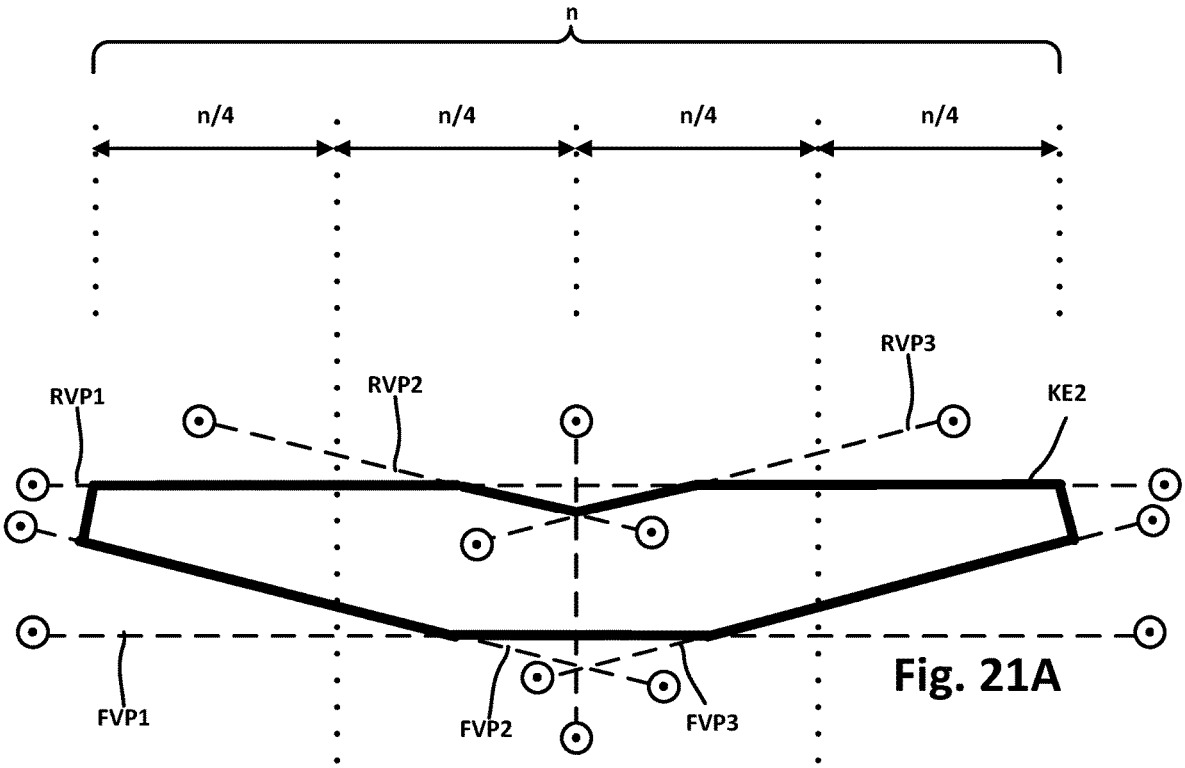
FIGS. 21A and 21B are top plan views of various alternative key and key envelope configurations.
Figure 21B:
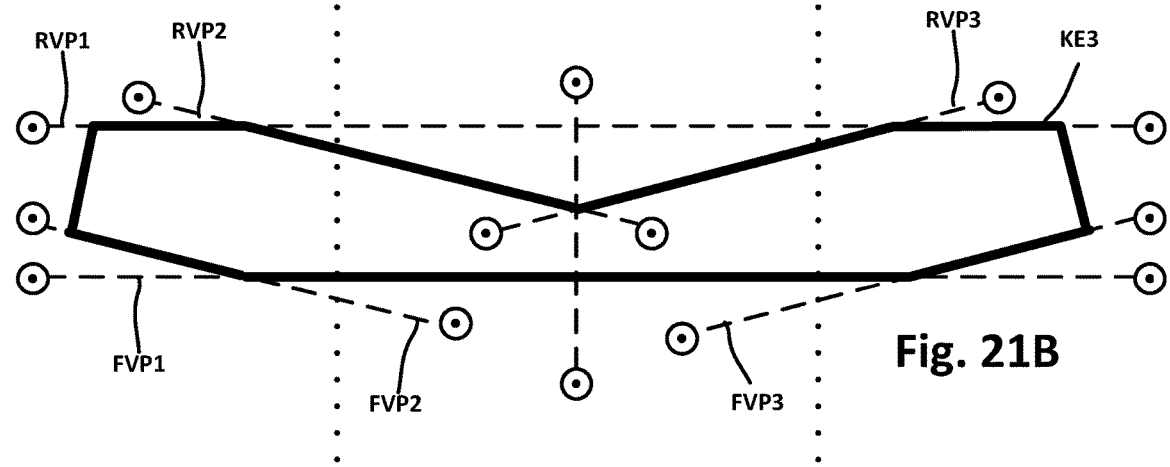

FIG. 20 is a top plan view of key 300 of trapezoidal retaining wall block 50, in isolation, showing where planes intersect in order to provide a forward shift of Z/2, given a key length of n. Key 300 fills key envelope KE entirely. In the event that more or less of a forward shift than Z/2 is desired, the intersection points can be adjusted. For example, FIGS. 21A and 21B are top plan views of various alternative key configurations with respective different key envelopes. In particular, FIG. 21A shows a suitable key envelope KE2 (which could be filled entirely by a corresponding key) for a forward shift of less than Z/2, wherein the intersection points are less than halfway between central vertical plane CVP and respective sides 220, 200. FIG. 21B shows a suitable key envelope KE3 (which could be filled entirely by a corresponding key) for a forward shift of more than Z/2, where in the intersection points are more than halfway between central vertical plane CVP and respective sides 220, 200. Each of these key envelopes KE2, KE3, as in key envelope KE, provide left side and right side portions of keys, with each of the left side portion and right side portion being shaped to reduce in width towards both the left and right sides of the block. In all cases, for KE, KE2 and KE3, the distance between rear vertical plane RVP1 and front vertical plane FVP1 is about the same as width of groove 400, accounting for groove 400 having a slightly larger width due to a tolerance, so that groove 400 can receive whichever key fits within the envelope, whether rotated for a curved wall or aligned for a straight one, and has suitable bearing surfaces.

The vertical interlock system that includes groove 400 and key 300 as described above is useful for providing key 300 with bearing surfaces against which groove 400 of a like block 50 in a subsequent course can bear, rather than bearing on single left and right points as in the '456 patent. By providing a larger contact area, key 300 can avoid point loading and provide a more continuous contact. As a result, greater pressure distribution and shear resistance against earth pressures, particularly when using blocks in larger engineered applications, are achievable.

Figure 22:
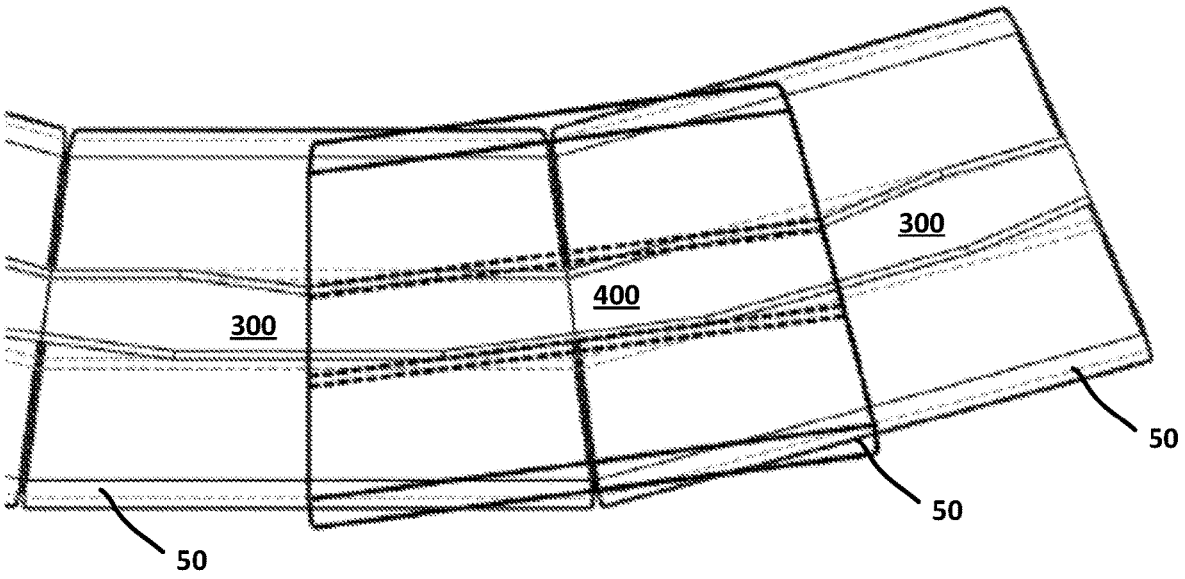
FIG. 22 is a top plan view of parts of the keys of two of the retaining wall blocks of FIG. 15 along a course of a curved wall interfacing with the groove of another of the retaining wall blocks along an upper course of the curved wall.
Figure 22A:
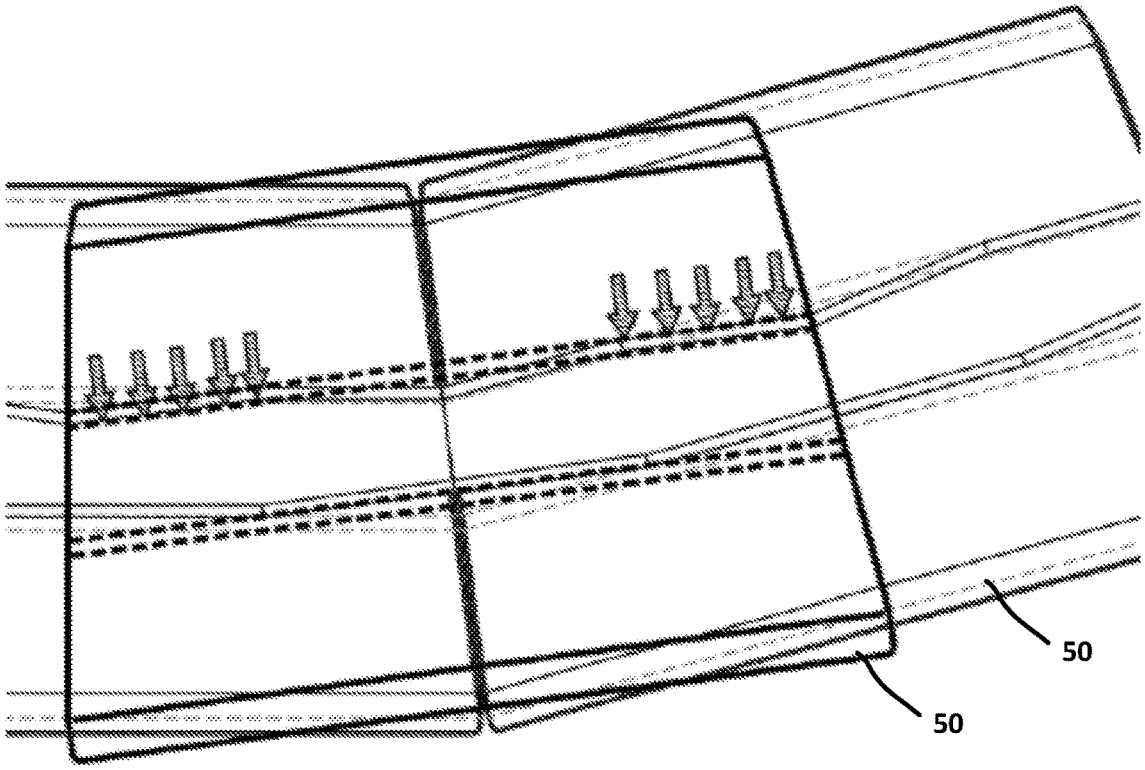
FIG. 22A is a magnified top plan view of a portion of FIG. 22, with arrows showing the distribution of force.

FIG. 22 is a top plan view of parts of keys 300 of two retaining wall blocks 50 along a course of a curved wall interfacing with the groove 400 of another retaining wall block 50 along an upper course of the curved wall. FIG. 22A is a magnified top plan view of a portion of FIG. 22, with arrows showing the distribution of the force from the rear across contact areas provided by key 300.

Figure 23:
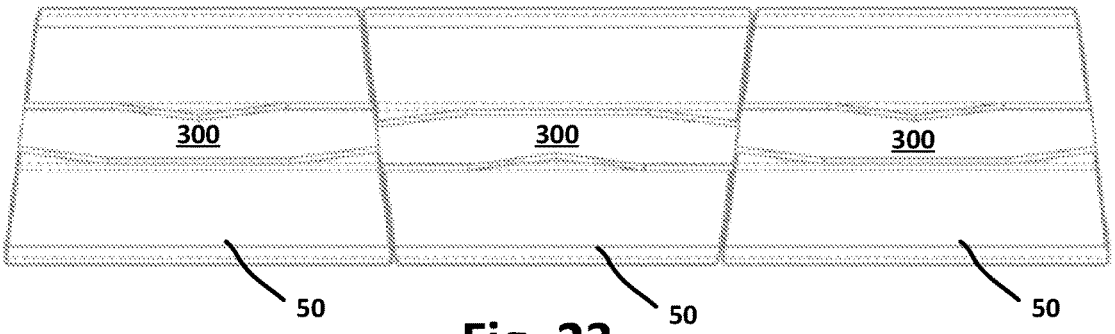
FIG. 23 is a top plan view of a number of the retaining wall blocks of FIG. 15 arranged as a straight wall.
Figure 24:
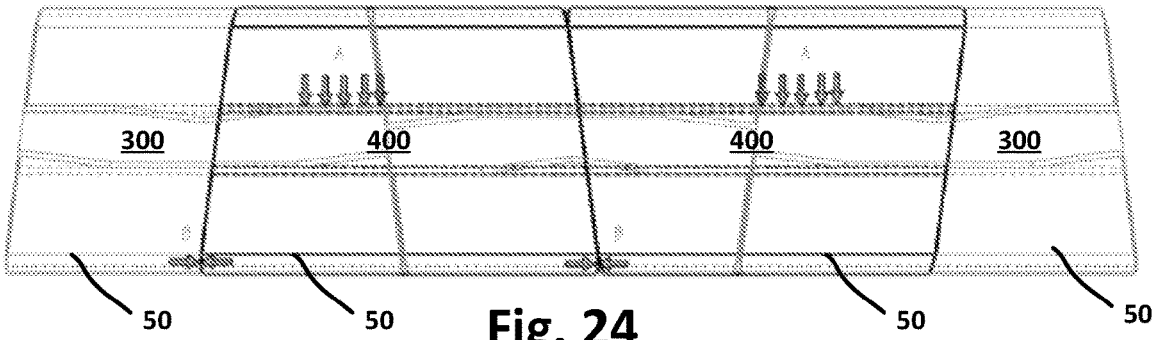
FIG. 24 is a top plan view of the keys of three of the retaining wall blocks of FIG. 15 along a first course of a straight wall interfacing with the grooves of another two of the retaining wall blocks of FIG. 15 along a subsequent course of the straight wall.

FIG. 23 is a top plan view of a number of retaining wall blocks 50 arranged as a straight wall in a single course. FIG. 24 is a top plan view of the keys 300 of three of retaining wall blocks 50 along a first course of a straight wall interfacing with the grooves 400 of another two retaining wall blocks 50 along a subsequent course of the straight wall. Arrows show the distribution of force from the rear across contact areas provided by key 300, inhibiting rotation of the uppermost blocks under pressure from material to be retained. Lateral arrows show blocks 50 interfering with rotation of adjacent blocks 50.

Figure 24A:
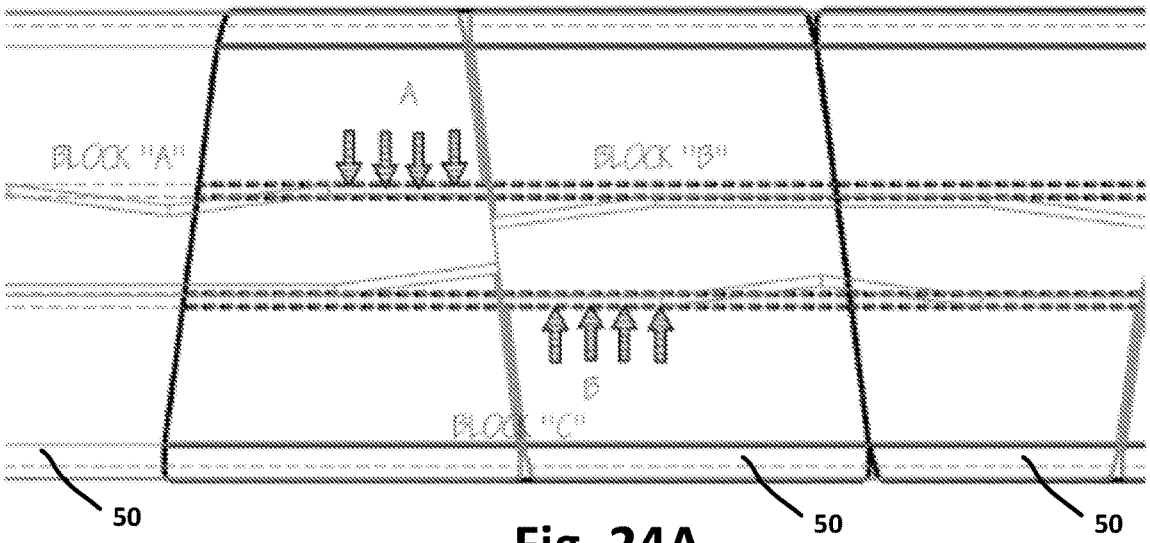
FIG. 24A is a magnified top plan view of the keys of two of the retaining wall blocks of FIG. 23 interfacing with the grooves of another two of the retaining wall blocks in a subsequent course of the straight wall.

FIG. 24A is a magnified top plan view of the keys 300 of two retaining wall blocks 50 interfacing with grooves 400 of another two retaining wall blocks 50 along a subsequent course of the straight wall. A "self-aligning" effect is provided by key 300, in that, to maintain the desired vertical alignment in the wall, each subsequent course must be placed directly on top of the course below, without any shifting towards the front or rear. Whereas in prior art tolerances allow a block to be shifted off-centre as it is being installed by the full amount of the tolerance, when stacked block 50 provides and is provided with contact areas on both the front and the back of groove 400, as shown in FIG. 24A. That is, contact surface "A" from key 300 of Block A provides a first alignment area for the second course (Block C), contact surface "B" from key 300 of Block B provides a second alignment area for the second course (Block c). Each contact surface is located at the furthest point toward the back (i.e., surface "A") and front (i.e. surface "B") of the groove 400, causing it to be held at the exact centreline of the blocks 50 below, thereby to provide vertical alignment.

Figure 25:
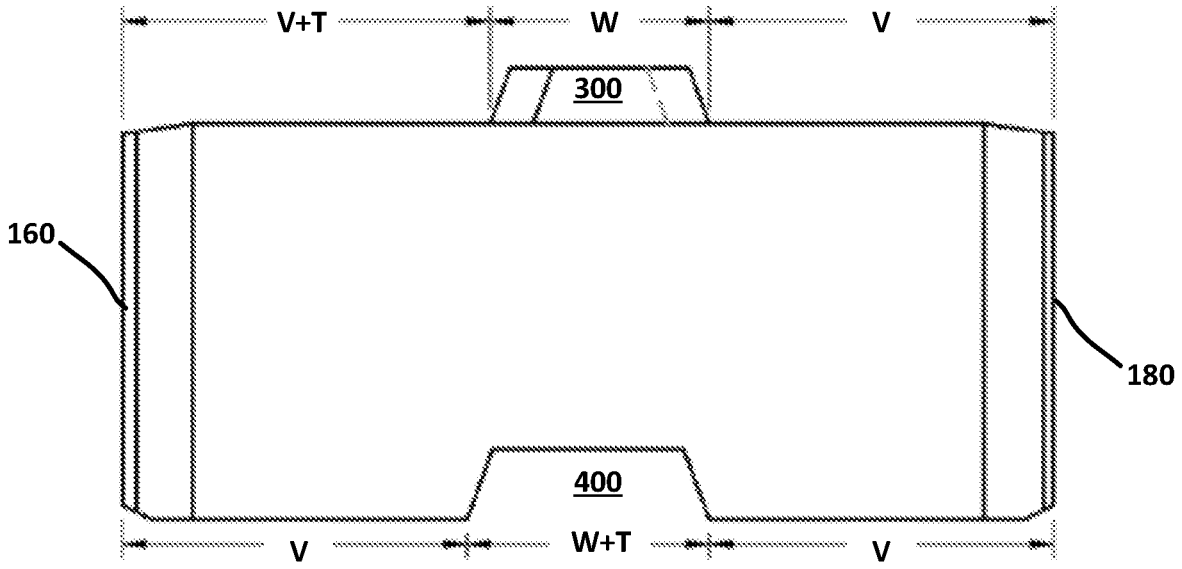
FIG. 25 is a right side elevation view of the retaining wall block of FIG. 15.

FIG. 25 is a right side elevation view of retaining wall block 50. In this embodiment, key 300 is farther from front side 160 of block 50 than is groove 400. In particular, whereas groove 400 begins at a distance V from front side 160, key 300 begins at a distance V+T from front side 160, where T corresponds to the amount of tolerance added to width W of groove 400. This enables block 50 to be stacked with like blocks 50 without causing the wall to be over-vertical.

While embodiments have been described, alternatives are possible.

What is claimed is:

1. A retaining wall block comprising:

a block body comprising:

a top side and a bottom side parallel to the top side, each of the top side and the bottom side being trapezoidal in shape and symmetrical with respect to a central vertical plane;

a front side and a rear side parallel to the front side; and a right side and a left side opposite the right side; and a vertical interlock system comprising:

a groove having a groove depth and a groove width and extending transverse to the central vertical plane along the bottom side from the left side to the right side; and a key extending transverse to the central vertical plane along the top side and having a maximum key width that is smaller than or equal to the groove width, the key having a maximum key height that is smaller than or equal to the groove height, wherein the key has a left side portion and a right side portion, and each of the left side portion and the right side portion is shaped to reduce in width toward both the left and right sides of the block;

and further wherein:

the left side portion of the key has a first segment and a second segment between the first segment and the central vertical plane, the first segment having a rear-facing wall that is normal to the central vertical plane and a front-facing wall that is normal to the left side, the second segment having a rear-facing wall that is normal to the left side and a front-facing wall that is normal to the central vertical plane; and the right side portion of the key has a third segment between a fourth segment and the central vertical plane, the third segment having a rear-facing wall that is normal to the right side and a front-facing wall that is normal to the central vertical plane, the fourth segment having a rear-facing wall that is normal to the central vertical plane and a front-facing wall that is normal to the right side.

2. The retaining wall block of claim 1, wherein at least one of the left side portion and the right side portion is shaped to reduce in width from the maximum key width toward both the left and right sides of the block.

3. The retaining wall block of claim 1, wherein at least the first segment and the second segment are contiguous.

4. The retaining wall block of claim 3, wherein:

the rear-facing wall of the first segment and the rear-facing wall of the second segment meet at about halfway between the central vertical plane and the left side of the retaining wall block; and the front-facing wall of the first segment and the front-facing wall of the second segment meet at about halfway between the central vertical plane and the left side of the retaining wall block.

5. The retaining wall block of claim 1, wherein at least the third segment and the fourth segment are contiguous.

6. The retaining wall block of claim 5, wherein:

the rear-facing wall of the third segment and the rear-facing wall of the fourth segment meet at about halfway between the central vertical plane and the right side of the retaining wall block; and the front-facing wall of the third segment and the front-facing wall of the fourth segment meet at about halfway between the central vertical plane and the right side of the retaining wall block.

7. The retaining wall block of claim 1, wherein the first, second, third and fourth segments are contiguous.

8. The retaining wall block of claim 1, wherein the left portion and the right portion are mirrored in shape and position about the vertical plane.

9. The retaining wall block of claim 1, wherein the key is farther from the front side of the retaining wall block than is the groove.

10. The retaining wall block of claim 1, wherein each of the groove and the key is bevelled.

11. A retaining wall block comprising:

a block body comprising:

a top side and a bottom side parallel to the top side, each of the top side and the bottom side being trapezoidal in shape and symmetrical with respect to a central vertical plane;

a front side and a rear side parallel to the front side; and a right side and a left side opposite the right side; and a vertical interlock system comprising:

a groove having a groove depth and a groove width and extending transverse to the central vertical plane along the bottom side from the left side to the right side; and a key extending transverse to the central vertical plane along the top side and having a maximum key width that is smaller than or equal to the groove width, the key having a maximum key height that is smaller than or equal to the groove height, wherein the key includes a first rear-facing wall segment and a fourth rear-facing wall segment that are both normal to the central vertical plane and that together flank a second rear-facing wall segment and a third rear-facing wall segment, wherein the second rear-facing wall segment and the third rear-facing wall segment are normal to the left side and to the right side respectively, the key also including first and fourth front-facing wall segments that are normal to the left side and the right side respectively and that together flank a second front-facing wall segment and a third front-facing wall segment that are both normal to the central vertical plane.

12. The retaining wall block of claim 11, wherein the first, second, third and fourth rear-facing wall segments are contiguous, and the first, second, third and fourth front-facing wall segments are contiguous.

13. The retaining wall block of claim 11, wherein the key is mirrored in shape and position about the central vertical plane.

14. The retaining wall block of claim 11, wherein:

the first rear-facing wall segment and the second rear-facing wall segment meet at about halfway between the central vertical plane and the left side of the retaining wall block; and the first front-facing wall segment and the second front-facing wall segment meet at about halfway between the central vertical plane and the left side of the retaining wall block.

15. The retaining wall block of claim 14, wherein:

the third rear-facing wall segment and the fourth rear-facing wall segment meet at about halfway between the central vertical plane and the right side of the retaining wall block; and the third front-facing wall segment and the fourth front-facing wall segment meet at about halfway between the central vertical plane and the right side of the retaining wall block.

16. The retaining wall block of claim 11, wherein the key is farther from the front side of the retaining wall block than is the groove.

17. The retaining wall block of claim 11, wherein:

a first rear vertical plane along which the first and fourth rear-facing wall segments extend intersects a second rear vertical plane along which the second rear-facing wall extends at about halfway between the central vertical plane and the left side of the retaining wall block; and the first rear vertical plane intersects a third rear vertical plane along which the third rear-facing wall extends at about halfway between the central vertical plane and the right side of the retaining wall block.

18. The retaining wall block of claim 17, wherein:

a first front vertical plane along which the second and third front-facing wall segments extend intersects a second rear vertical plane along which the first front-facing wall extends at about halfway between the central vertical plane and the left side of the retaining wall block; and the first front vertical plane intersects a third front vertical plane along which the fourth front-facing wall extends at about halfway between the central vertical plane and the right side of the retaining wall block.

19. The retaining wall block of claim 11, wherein each of the groove and the key is bevelled.

* * * * *